US010047296B2

(12) United States Patent
Wang

(10) Patent No.: US 10,047,296 B2
(45) Date of Patent: Aug. 14, 2018

(54) THERMAL CYCLE CONTINUOUS AUTOMATED COAL PYROLYZING FURNACE

(71) Applicant: SHANXI XINLI ENERGY TECHNOLOGY CO., LTD, Taiyuan, Shanxi (CN)

(72) Inventor: Xinmin Wang, Shanxi (CN)

(73) Assignee: SHANXI XINLI ENERGY TECHNOLOGY CO., LTD, Taiyuan, Shanxi (CN)

( * ) Notice: Subject to any disclaimer, the term of this patent is extended or adjusted under 35 U.S.C. 154(b) by 543 days.

(21) Appl. No.: 14/419,937

(22) PCT Filed: Aug. 5, 2013

(86) PCT No.: PCT/CN2013/080796
§ 371 (c)(1),
(2) Date: Feb. 6, 2015

(87) PCT Pub. No.: WO2014/023202
PCT Pub. Date: Feb. 13, 2014

(65) Prior Publication Data

US 2015/0191654 A1 Jul. 9, 2015

(30) Foreign Application Priority Data

Aug. 6, 2012 (CN) ..... 2012 1 0279414

(51) Int. Cl.
*C10B 31/00* (2006.01)
*C10B 21/10* (2006.01)
(Continued)

(52) U.S. Cl.
CPC ..... *C10B 31/00* (2013.01); *C10B 3/00* (2013.01); *C10B 3/02* (2013.01); *C10B 21/00* (2013.01);
(Continued)

(58) Field of Classification Search
CPC ..... C10B 39/02; C10B 21/18; C10B 1/04; C10B 49/06; C10B 3/02; C10B 31/04; C10B 31/02; C10B 17/00
See application file for complete search history.

(56) References Cited

U.S. PATENT DOCUMENTS 1,443,161 A * 1/1923 Balz ..... C10B 1/04 202/115
1,779,958 A * 10/1930 Becker ..... C10B 3/02 202/123
(Continued)

FOREIGN PATENT DOCUMENTS

GB 261799 A * 4/1927 ..... C10B 31/02
GB 306933 A * 9/1929 ..... C10B 39/02
(Continued)

OTHER PUBLICATIONS

Hayakawa (JP 2010003373) English Machine Translation obtained from Espacenet.com Jul. 6, 2017.*

*Primary Examiner* — Bobby Ramdhanie
*Assistant Examiner* — Briana M Obenhuber

(57) ABSTRACT

A thermal cycle continuous automated coal pyrolyzing furnace, includes a furnace body, a coal feeding device, a preheating device, an inputting coal regulating bunker, an inputting coal cooling device, a coal pyrolyzation coking device, a coke modification device, a dry quenching device and a raw gas exporting device; wherein the coal feeding device, the pre-heating device, the inputting coal regulating bunker, the inputting coal cooling device, the coal pyrolyzation coking device, the coke modification device, the dry quenching device and the raw gas exporting device are all integrated on the furnace body; the coal pyrolyzation coking device includes a coking chamber, an external combustion gas heating device, an internal combustion gas heating device and a flame path bow. Utilizing the coal pyrolyzing
(Continued)

furnace is capable of achieving continuously quenching, so as to improve quenching efficiency and decrease quenching cost.

5 Claims, 18 Drawing Sheets

(51) Int. Cl.

| | |
|---|---|
| ***C10B 39/02*** | (2006.01) |
| ***C10B 3/00*** | (2006.01) |
| ***C10B 3/02*** | (2006.01) |
| ***C10B 31/02*** | (2006.01) |
| ***C10B 33/12*** | (2006.01) |
| ***C10B 21/00*** | (2006.01) |
| ***C10B 21/16*** | (2006.01) |

(52) U.S. Cl.
CPC ..... *C10B 21/10* (2013.01); *C10B 21/16* (2013.01); *C10B 31/02* (2013.01); *C10B 33/12* (2013.01); *C10B 39/02* (2013.01)

(56) References Cited

U.S. PATENT DOCUMENTS 1,872,531 A * 8/1932 Van Ackeren ..... C10B 3/02 202/123
1,938,596 A * 12/1933 Karrick ..... C10B 1/04 202/118
1,953,040 A * 3/1934 Brandegee ..... C10B 1/04 201/15
4,043,471 A * 8/1977 Trumbull ..... B01J 3/02 414/287
4,197,165 A * 4/1980 Knappstein ..... C10B 31/00 202/262
4,263,100 A * 4/1981 Stalherm ..... C10B 31/00 201/23
4,284,477 A * 8/1981 Mansfield ..... C10B 15/00 202/110
4,333,910 A * 6/1982 Lorrek ..... C10B 33/12 202/241

FOREIGN PATENT DOCUMENTS

GB 461402 A * 2/1937 ..... C10B 3/00
JP 2010223373 A * 10/2010

* cited by examiner

THERMAL CYCLE CONTINUOUS AUTOMATED COAL PYROLYZING FURNACE

CROSS REFERENCE OF RELATED APPLICATION

This is a U.S. National Stage under 35 U.S.C 371 of the International Application PCT/CN2013/080796, filed Aug. 5, 2013, which claims priority under 35 U.S.C. 119(a-d) to CN 201210279414.3, filed Aug. 6, 2012.

BACKGROUND OF THE PRESENT INVENTION

Field of Invention

The present invention relates to a coal pyrolyzing furnace, and more particularly to a thermal cycle continuous automated coal pyrolyzing furnace.

Description of Related Arts

Conventionally, coal pyrolyzing furnaces (coke ovens) on the market usually utilize intermittent coking, wherein the proportion of inputting coal, dehydration, coal feeding, preheating, carbonization, coke modification, dry quenching, etc. are relatively independent, which results in discontinuous production and low productivity. In addition, raw gas produced during coal pyrolyzing comprises many useful ingredients, such as $H_2S$, HCL acid gases, $NH_3$ alkaline gas, tar, benzene, naphthalene, and absorber oil. There is no complete technique for exporting, recovering, purifying and utilizing the raw gas.

This prompted the present inventors to explore and create a complete set of techniques for continuous coking as well as exporting, recovering, purifying and recycling the raw gas.

SUMMARY OF THE PRESENT INVENTION

The present invention provides a thermal cycle continuous automated coal pyrolyzing furnace, which is capable of combining the coal feeding, pre-heating, coking, modification and dry quenching technologies into a whole for achieving the continuous coking, so as to improve the coking efficiency and reduce the coking cost.

In order to achieve the objects mentioned above, technical solutions are adopted as follows.

A thermal cycle continuous automated coal pyrolyzing furnace, comprises: a furnace body, a coal feeding device, a plurality of preheating devices, an inputting coal regulating bunker, an inputting coal cooling device, a coal pyrolyzation coking device, a coke modification device, a dry quenching device and a raw gas exporting device;

wherein the coal feeding device, the preheating devices, the inputting coal regulating bunker, the inputting coal cooling device, the coal pyrolyzation coking device, the coke modification device, the dry quenching device and the raw gas exporting device are all integrated on the furnace body;

the coal pyrolyzation coking device comprises a coking chamber, an external combustion gas heating device, an internal combustion gas heating device and a flame path arch;

the coal feeding device comprises: an inputting coal dust conveyor, an inputting bunker, a coal dust direction divider, a coal dust distribution chamber, an inputting bunker discharge duct and a coal dust filter;

the coal dust filter is located above the inputting coal dust conveyor, the inputting coal dust conveyor adopts a screw conveying structure and is provided on a top of the inputting bunker, the convex coal dust direction divider is provided on a middle of a bottom of the inputting coal bunker and divides the bottom of the inputting bunker into a plurality of coal dust distribution chambers;

the inputting bunker discharge duct is provided on the coal dust distribution chambers, and a discharge control valve is provided on the inputting bunker discharge duct;

the preheating devices are provided below the coal feeding device and on a top of the coal pyrolyzing furnace;

each preheating device comprises a furnace body, an exhaust gas chamber, at least one exhaust gas preheating pipe and a preheater;

wherein the furnace body comprises an internal layer wall, a middle layer wall and an external layer wall;

the internal layer wall forms the exhaust gas chamber, and an exhaust gas gathering loop channel is formed between the middle layer wall and the external layer wall;

the exhaust gas gathering loop channel has an exhaust gas main outlet, the exhaust gas preheating pipe passes through the internal layer wall and the middle layer wall for communicating the exhaust gas chamber with the exhaust gas gathering loop channel, and divides a position between the internal layer wall and the middle layer wall into a plurality of preheating chambers, the preheaters are respectively provided in each of the preheating chambers;

a hot exhaust gas inputting pipe is provided on a bottom of the exhaust gas chamber, hot exhaust gas after burning enters the hot exhaust gas inputting pipe, accesses the exhaust gas gathering loop channel via the exhaust gas preheating pipe, and finally is discharged via the exhaust gas main outlet of the exhaust gas gathering loop channel, hot exhaust gas after burning performs heat conduction on the exhaust gas preheating pipe, the internal layer wall and the middle layer wall during the process of discharging;

the inputting coal regulating bunker is provided on the coking chamber below the preheating devices of the coal pyrolyzing furnace, the inputting coal regulating bunker comprises: a small bunker, a bunker feeding level indicator, a bunker discharging level indicator, a small bunker discharging pipe and a small bunker discharging valve;

a top portion of the small bunker is connected with a bottom portion of the preheating device, the bunker feeding level indicator and the bunker discharging level indicator are respectively provided on a top and a bottom of the small bunker, the small bunker discharging pipe is connected on a bottom of the small bunker via the small bunker discharging valve and extends to the coking chamber of the coal pyrolyzing furnace;

wherein the inputting coal cooling device comprises: an air inlet pipe, an air outlet pipe, an air inlet loop pipe, an air outlet loop pipe, an air inlet branch pipe, an air outlet branch pipe and a cooling air duct;

wherein the air inlet pipe is communicated with the air inlet loop pipe and the air outlet pipe is communicated with the air outlet loop pipe;

the air inlet loop pipe and the air outlet loop pipe are respectively provided on a periphery of the furnace body of the coal pyrolyzing furnace;

the air inlet branch pipe and the air outlet branch pipe are respectively provided on the air inlet loop pipe and the air outlet loop pipe;

wherein the air inlet branch pipe is provided on a lower portion of the cooling air duct, and the air outlet branch pipe is provided on an upper portion of the cooling air duct;

the small bunker discharging pipe passes through the cooling air duct and extends to the coking chamber;

the coal pyrolyzing coking device, the coke modification device and the dry quenching device are formed integrally from top to down on the furnace body, and the coal pyrolyzing coking device is arranged in a center of the furnace body, which comprises: the coking chamber, the external gas heating device, the internal burning heating device and the flame path arch;

the coking chamber is in a loop chamber above the flame path arch, the loop chamber is formed by an internal loop wall and an external loop wall made of fire-resistant and heat-conductive materials; the external gas heating device is around an external circle of the external loop wall of the coking chamber, wherein the external gas heating device comprises at least one equal set of a first gas heater, a second gas heater and a gas reversing device;

the internal burning heating device is provided inside the internal loop wall of the coking chamber, the internal burning heating device comprises at least one set of third gas heaters and fourth gas heaters which have same structures and coke quenching exhaust heaters;

wherein the coke modification device is located on the flame path arch within the furnace body, and comprises a coke modification room formed by the lower portion of the coking chamber, a lower portion of an internal main flame path and a lower internal sub flame path section of the internal burning heating device, a lower portion of a high temperature combustible waste gas inputting path of a central path encircled by a central annular wall of the internal burning heating device, wherein a combustible exhaust inputting hole is provided on a lower portion of the central annular wall for communicating the high temperature combustible waste gas inputting path with the internal main flame path and the lower internal sub flame path section;

the dry quenching device is located below the coking chamber, the coke modification device, the internal burning heating device and the flame path arch in the coal pyrolyzing furnace and comprises a high temperature coke quenching room, a low temperature coke quenching room, a coke quenching bridge arch and a coke quenching exhaust blower;

the high temperature coke quenching room is provided below the flame path arch, a top portion of the high temperature coke quenching room is communicated with the high temperature combustible waste gas path;

the coke quenching bridge arch is located between the high temperature coke quenching room and the low temperature coke quenching room and comprises a bridge arch, a wind collecting room, a dry quenching wind annular path and a dry quenching wind tube;

at least one bridge arch is radially arranged within the quenching wind annular path at a certain degree from an axial center of the high temperature coke quenching room and the low temperature coke quenching room, a middle of the bridge arch forms the wind collecting room having an inversed conical shape with an upper large diameter and a lower small diameter, a semi-spherical air cap is located at a top of the wind collecting room, an opening at the lower portion of the wind collecting room faces to the low temperature coke quenching room;

the dry quenching wind tube is located within the bridge arch, one end of the dry quenching wind tube leads to the wind collecting room, the other end of the dry quenching wind tube leads to the dry quenching wind annular path, the dry quenching wind annular path is connected with the coke quenching exhaust blower via a wind inputting tube; a coking valve is located at a bottom opening of the low temperature coke quenching room;

wherein the raw gas exporting device comprises a raw gas collection chamber, an internal exporting pipe, an external exporting pipe, a main exporting pipe and a loop exporting pipe;

wherein the raw gas collection chamber is provided on a top of the coking chamber and forms an integrated body with the coking chamber;

the internal exporting pipe is located inside a flame path isolating wall;

an internal exporting pipe inlet passes through the internal loop wall of the coking chamber and extends to the coking chamber;

an internal exporting pipe outlet passes through the internal loop wall and extends to the raw gas collection chamber on a top of the coking chamber;

the external exporting pipe is located in an external wall of the furnace body, and comprises a lower exporting pipe inlet and an upper exporting pipe inlet which pass through the external loop wall of the coking chamber and extend to the coking chamber;

an external exporting pipe outlet passes through the external loop wall and extends to the raw gas collection chamber on the top of the coking chamber;

the exporting main pipe is provided in the external wall of the furnace body of the coal pyrolyzing furnace, an exporting main pipe inlet is communicated with the raw gas collection chamber and extends upwardly to an exporting loop pipe on an upper portion of the external wall of the furnace body, and a raw gas exporting outlet is provided in the exporting loop pipe.

Preferably, the first gas heater of the external gas heating device comprises a first combustor, a first coal gas inputting sub-tube and a first storing heat exchanger, the first combustor forms a relatively closed coal gas combustion flame path, the first coal gas inputting sub-tube is communicated with a bottom of the first combustor, the first storing heat exchanger comprises a first heat storing chamber, a first heat storing body, a first air inputting sub-tube and a first exhaust outputting sub-tube, the first heat storing chamber is provided within an external wall of the furnace body, the first heat storing body is located within the first heat storing chamber, one end of the first heat storing chamber is communicated with the bottom of the first combustor, the other end of the first heat storing chamber is connected with the first air inputting sub-tube and the first exhaust outputting sub-tube; wherein the second gas heater comprises a second combustor, a second coal gas inputting sub-tube and a second storing heat exchanger, the second coal gas inputting sub-tube is communicated with a bottom of the second combustor, the second storing heat exchanger comprises a second heat storing chamber, a second heat storing body, a second air inputting sub-tube and a second exhaust outputting sub-tube, the second heat storing chamber is also provided within the external wall of the furnace body, the second heat storing body is located within the second heat storing chamber, one end of the second heat storing chamber is communicated with the bottom of the second combustor, the other end of the second heat storing chamber is connected with the second air inputting sub-tube and the second exhaust outputting sub-tube; wherein a combustor throughhole is provided between the first combustor and the second combustor; wherein the gas reversing device comprises an upper disk, a lower disk, a rotation reversing motor, an air blower, a coal gas blower and an exhaust blower, the lower disk is connected with an air main tube and a first air sub-tube, a second air sub-tube, a coal gas main tube and a first coal gas sub-tube, a second coal gas sub-tube, an exhaust main tube and a second exhaust sub-tube, and a first exhaust sub-tube, wherein the second exhaust sub-tube is exchanged with the first exhaust sub-tube, the first air sub-tube is exchanged with the second air sub-tube, and the first coal gas sub-tube is exchanged with the second coal gas sub-tube; wherein the upper disk is rotatably attached on the lower disk, an air communicating tube, a coal gas communicating tube and an exhaust communicating tube are located on the upper disk, the rotation reversing motor is driving-connected with the upper disk for driving the upper disk to reciprocately rotate on the lower disk; wherein, the first air sub-tube is connected with the first air inputting sub-tube, simultaneously, the first coal gas sub-tube is connected with the first coal gas inputting sub-tube, simultaneously, the first exhaust sub-tube is connected with the first exhaust outputting sub-tube; similarly, the second air sub-tube is connected with the second air inputting sub-tube, simultaneously, the second coal gas sub-tube is connected with the second coal gas inputting sub-tube via a second coal gas wrap-tube, simultaneously, the second exhaust sub-tube is connected with the second exhaust outputting sub-tube.

Preferably, the coke quenching exhaust heater of the internal burning heating device comprises an internal flame path, an air assisting tube, a primary gas refilling tube, a secondary gas refilling tube, a gas refilling loop, a center loop wall, an internal flame path isolating wall and a center pass, wherein the internal flame path is divided into at least one set of an internal main flame path and an internal sub flame path in parallel by the internal loop wall of the coking chamber, the center loop wall inside the internal loop wall of the coking chamber and at least one the internal flame path isolating wall; an upper sealing isolation plate and a lower sealing isolation plate are provided in the internal sub flame path and divide the internal sub flame path into an upper section, a middle section and a lower section, which forms an upper internal sub flame path section, a middle internal sub flame path section and a lower inter sub flame path section; an exhaust communicating hole is drilled on a flame path isolating wall between the upper internal sub flame path section and the internal main flame path; the center pass is formed by the center loop wall, a pass isolating plate is provided at a part of the center pass which is abreast of the upper sealing isolating plate for dividing the center pass into an upper portion and a lower portion, in such a manner that the upper portion forms a buffer area and the lower portion forms a high-temperature combustible exhaust inputting pass; an exhaust inputting hole is drilled on the center loop wall and passes through the buffer area, the internal main flame path and the upper internal sub flame path section; a combustible exhaust inputting hole is drilled at a bottom portion of the center loop wall and passes through the high-temperature combustible exhaust inputting pass, the internal main flame path and the lower internal sub flame path section; the gas refilling loop is provided on an external wall of the coal pyrolyzing furnace and communicates with the air assisting tube as well as the primary gas refilling tube and the secondary gas refilling tube; the primary gas refilling tube and the secondary gas refilling tube pass below a strip arch of the flame path arch and extend upwards for being inside the flame path isolating wall between the internal main flame path and the internal sub flame path; an opening of the primary gas refilling tube is arranged under the lower isolating plate and respectively connected to the internal main flame path and the internal sub flame path; an opening of the secondary gas refilling tube is connected to the internal main flame path; the middle internal sub flame path section forms a relatively closed independent gas combustor; adjacent middle internal sub flame path sections communicate with each other through a combustor pass and forms a cooperating set, the combustor pass is under the upper isolating plate and passes through the internal main flame path between the adjacent middle internal sub flame path sections; the third gas heater comprises a third combustor, a third coal gas inputting sub-tube, a third heat storing chamber, a third heat storing body, a third air inputting sub-tube and a third exhaust outputting sub-tube, wherein the third combustor is formed by the middle internal sub flame path section, the third coal gas inputting sub-tube passes below the strip arch of the flame path arch and extends upwards for being connected to the third combustor by passing through the flame path isolating wall which is formed by the middle internal sub flame path section; the third heat storing chamber is arranged on the body of the coal pycolyzing furnace under the strip arch, and the third heat storing body is arranged inside the third heat storing chamber; a first end of the third heat storing chamber passes below the strip arch of the flame path arch through an extending pass and extends upwards for being connected to a bottom of the third combustor by passing through the flame path isolating wall, a second end of the third heat storing chamber is respectively connected to the third air inputting sub-tube and the exhaust outputting sub-tube; similarly, the fourth gas heater equals to the third gas heater in structures, wherein a fourth combustor forms a parallel set with the third combustor through the combustor pass.

Preferably, the external gas heating device heats with an upper heating section, a middle heating section and a lower heating section, each heating section comprises a plurality of sets of the first gas heating devices and the second gas heaters with same structures.

Preferably, the thermal cycle continuous automated coal pyrolyzing furnace further comprising an industrial control core, wherein the industrial control core is connected with the inputting coal dust conveyor and the discharge control valve, so as to control the inputting coal dust conveyor and the discharge control valve, and the industrial control core is connected with a preheating chamber thermometer and an exhaust gas chamber thermometer for monitoring temperatures;

the industrial control core is electrically connected with the bunker feeding level indicator, the bunker discharging level indicator, the small bunker thermometer and the small bunker discharging valve, so as to regulate an amount of inputting coal and monitor temperature;

the industrial control core is electrically connected with a raw gas thermometer, and the industrial control core monitors temperatures of the raw gas collection chamber;

the industrial control core is connected with a burning chamber thermometer and automatically collects temperature data of the burning chamber thermometer;

the industrial control core is connected with the rotation reversing motor, the air lower, the coal gas blower and the exhaust blower, so as to control rotation of the rotation reversing motor, the air lower, the coal gas blower and the exhaust blower;

the industrial control core is electrically connected with a coke modification thermometer, so as to automatically monitor coke modification signals of the coke modification thermometer;

the industrial control core is electrically connected with a quenching thermometer, a quenching exhaust gas blower and a coke outlet exhaust gas valve, so as to automatically control the quenching exhaust gas blower and the coke outlet exhaust gas valve, and monitor quenching temperatures via the quenching thermometer; and the industrial control core is electrically connected with a raw gas thermometer, so as to monitor temperatures of the raw gas collection chamber.

Preferably, the coal dust filter comprises: a filter shell, an exhaust air internal inlet pipe, a dust funnel, an exhaust air internal outlet pipe and an exhaust air external outlet pipe;

the exhaust air internal inlet pipe is provided on a periphery of the filter shell and extends from a bottom to a top, the dust funnel is provided in the filter shell and extends to the bunker, the exhaust air internal outlet pipe is provided on a header of the filter and above the dust funnel;

an entrance of the exhaust air internal inlet pipe is higher than an entrance of the exhaust air internal outlet pipe, the exhaust air internal outlet pipe is provided on a header in the filter, and the exhaust air external outlet pipe is provided on a filter external header; and a metal fiber filter is provided between the filter internal header and the filter external cover.

The continuously quenching technologies of the present invention is capable of integrating coal inputting, preheating, coking, modification and dry quenching in one pyrolyzing furnace body, in such a manner that continuously quenching is achieved, which solves problems in the conventional intermittent coking technology of low efficiency, large plant areas for large amount of devices, high labor cost and etc.

BRIEF DESCRIPTION OF THE DRAWINGS

Further description of the preferred embodiments of the present invention is illustrated combining with the accompanying drawings.

FIG. 15-1 is a sketch view of network pipe connections of the gas inverting device and a combustion gas heating device.

DETAILED DESCRIPTION OF THE PREFERRED EMBODIMENT

Preferred embodiments of a thermal cycle continuous automated coal pyrolyzing furnace of the present invention are illustrated as follows.

Part I: Proportion and Preparation of Inputting Coal

The coal pyrolyzing furnace, according to a preferred embodiment of the present invention, is capable of obtaining cokes of different levels according to different proportions of inputting coal.

The specific steps are as follows.

1) Five different kinds of coal are selected, which are gas coal, fat coal, coking coal, one-third coking coal and lean coal.

2) Weight percentages of the five kinds of coal are respectively 20%~40% gas coal, 10%~20% fat coal, 10%~20% coking coal, 15%~30% one-third coking coal and 10~15% lean coal. The five different kinds of coal are mixed and then screened and crashed till a crashed particle size thereof is less than 5 mm for forming the inputting coal. Of course, other proportions and sizes of inputting coal are also adaptable to the coal pyrolyzing furnace of the present invention. Therefore, inputting coal powder of the coal pyrolyzing furnace of the present invention is not limited. According to the proportion mentioned above, additive amount of weakly caking coal is capable of reaching 40% or more, which not only reduces the cost of the inputting coal but also is capable of obtaining high quality coke, and thus has strong competitive power on the market.

Part II: Dehydration of Inputting Coal

Conventionally, most of the coke ovens on the market utilize intermittent coking, and inputting coal thereof are wet coal, which results in large energy consumption and increases coking costs. By pre-dehydrating the inputting coal of the coal pyrolyzing furnace through a dehydration device, energy is saved.

Figure 1:
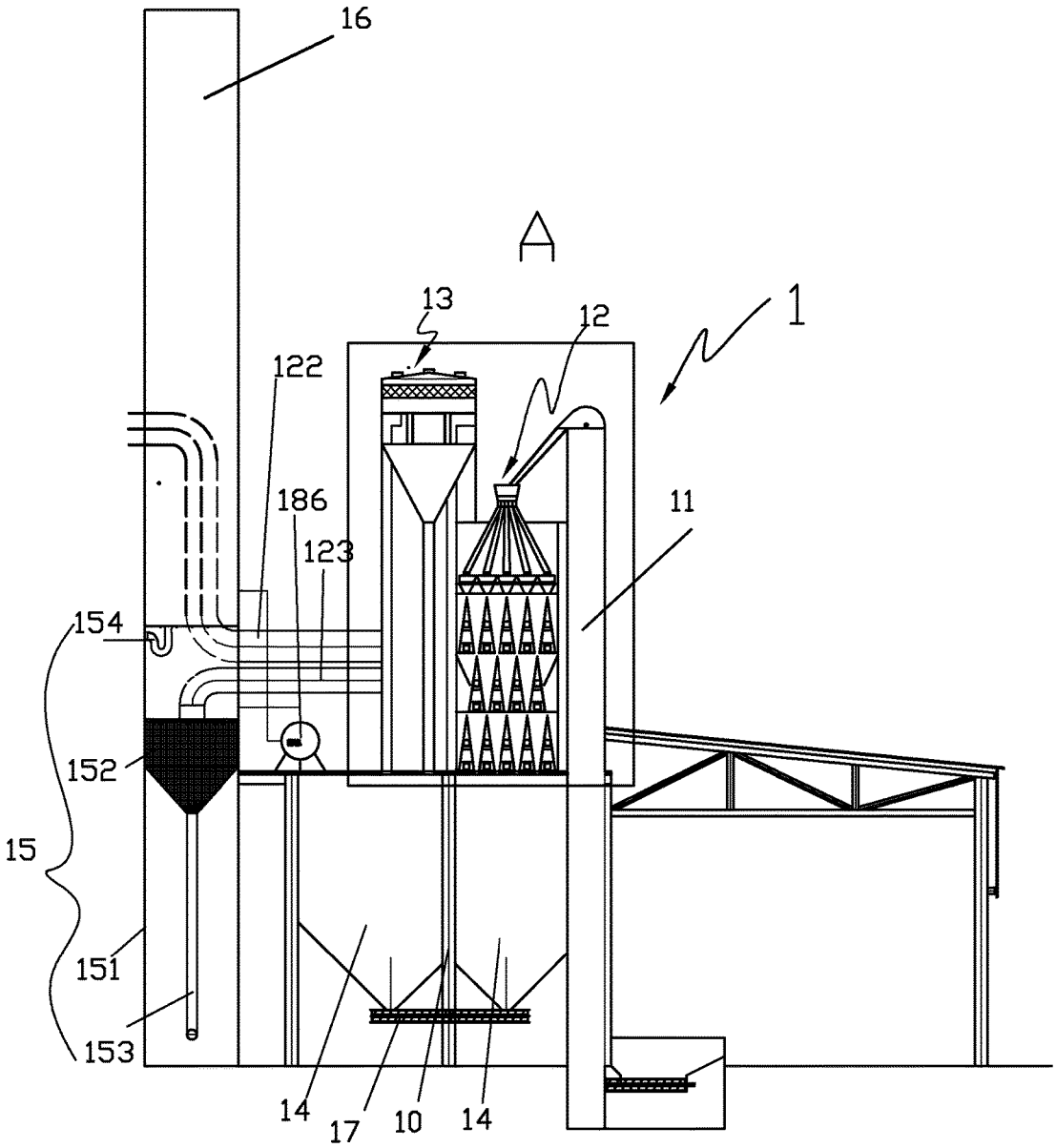
FIG. 1 is a sketch view of assembles of an inputting coal dehydration device of the present invention.

As shown in FIG. 1, an inputting coal dehydration device 1 comprises a dehydration frame 10, a bucket elevator 11, an exhaust gas dehydration device 12, a coal dust filter 13, a bunker 14, a dust remover 15, a chimney 16 and an inputting coal conveyor 17.

Figure 2:
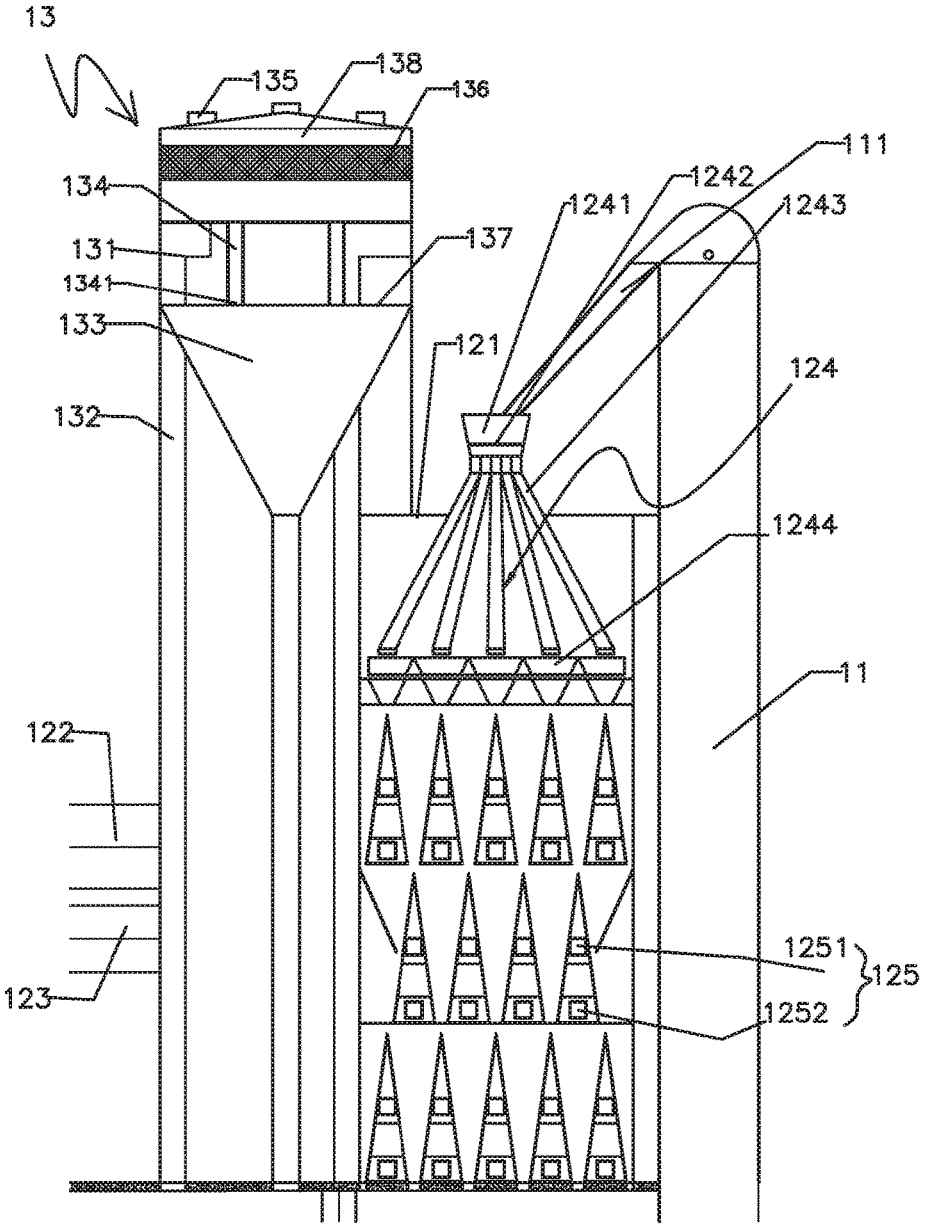
FIG. 2 is a sketch view of an exhaust gas dehydration device of the present invention. (which is also an enlarged view of A in FIG. 1).

Referring to FIG. 1 and FIG. 2, the exhaust gas dehydration device 12 comprises a dehydration device shell 121, a hot exhaust gas main inlet pipe 122, a dehydrated exhaust gas main outlet pipe 123, a feeder 124 and an exhaust gas radiator 125. The feeder 124 is provided on an upper portion of the dehydration device shell 121. At least one group of exhaust gas radiators 125 are provided under the feeder 124 and inside the dehydration device shell 121. Hot exhaust gas main inlet pipes 1251 and dehydrated exhaust gas outlet pipes 1252 are provided in the exhaust gas radiators 125. The hot exhaust gas main inlet pipes 1251 and the dehydrated exhaust gas outlet pipes 1252 are respectively communicated with the hot exhaust gas main inlet pipe 122 and the dehydrated exhaust gas main outlet pipe 123. The hot exhaust gas main inlet pipes 1251 and the dehydrated exhaust gas outlet pipes 1252 are respectively provided on an upper and a lower portion inside the exhaust gas radiator 125, so as to facilitate dehydration of the inputting coal.

As shown in FIG. 1 and FIG. 2, the feeder 124 comprises a feeding hopper 1241, a plurality of feeding vibrating screens 1242, a plurality of discharge ducts 1243 and a discharge vibrating screen 1244, wherein the feeding vibrating screen 1242 is provided in the feeding hopper 1241, the discharge ducts 1243 are provided on and dispersed from a center of a bottom end of the feeding hopper 1241, the discharge vibrating screen 1244 is provided on a bottom end of the discharge ducts 1243, and the exhaust gas radiator 125 is provided on a bottom end of the discharge vibrating screen 1244. An object of the design is to make the distribution of the inputting coal more uniform above the exhaust gas radiator 125.

As shown in FIG. 2, the exhaust gas radiators 125 are arranged in three groups of an upper group, a lower group and a middle group. The shape of the exhaust gas radiators is an upward acute triangle. The upper group of the exhaust gas radiators 125 and the middle group of the exhaust gas radiators 125 are arranged in dislocation, i.e., the lower group of the exhaust gas radiators 125 is provided under a position between two adjacent exhaust gas radiators 125 of the middle group. Similarly, the lower group of the exhaust gas radiators 125 is provided under a position between two adjacent exhaust gas radiators 125, so as to increase dehydration area of the inputting coal and facilitate distribution and sliding down of the coal.

Figure 3:
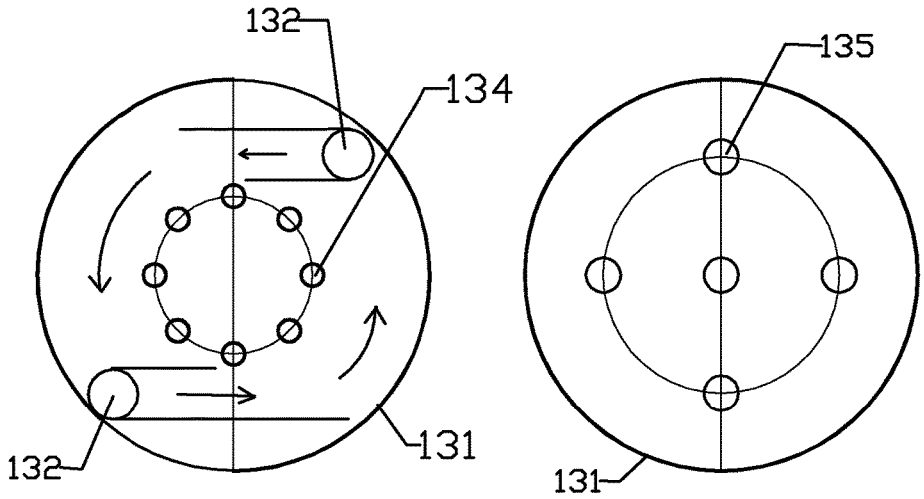
FIG. 3 is a top view of a coal dust filter according to a first preferred embodiment of the present invention.

Referring to FIGS. 1-3, a bunker 14 is provided below the exhaust gas radiators 14. The coal dust filter 13 is provide above the exhaust gas radiators 14 and is called coal dust re-breather. The coal dust filter 13 comprises: a filter shell 131, an exhaust air internal inlet pipe 132, a dust funnel 133, an exhaust air internal outlet pipe 134 and an exhaust air external outlet pipe 135. The exhaust air internal inlet pipe 132 is provided on a periphery of the filter shell 131 and extends from a bottom to a top. The dust funnel 133 is provided in the filter shell 131 and extends to the bunker 14. The exhaust air internal outlet pipe 134 is provided above the dust funnel 133. An entrance of the exhaust air internal inlet pipe 132 is higher than an entrance 1341 of the exhaust air internal outlet pipe 134. The exhaust air internal outlet pipe 134 is provided on a header 137 in the filter. The exhaust air external outlet pipe 135 is provided on a filter external header 138. A metal fiber filter 136 is provided between the filter internal header 137 and the filter external cover 138.

As shown in FIG. 3, the exhaust air internal inlet pipe 132 is provided in the filter shell 131. The exhaust air internal inlet pipe 132 and the exhaust air internal outlet pipe 134 are at a vertical angle to form a cyclone structure in the filter shell 131.

As shown in FIG. 1, the dust remover 15 is connected with the dehydrated exhaust gas main outlet pipe 123. The dust remover 15 is a conventional technique. The dust remover 15 comprises: a dust remover shell 151 and a dust removing chamber 152. The dehydrated exhaust gas main outlet pipe 123 extends to the dust removing chamber 152, and the dust removing chamber 152 is communicated with the chimney 16 via an induced draft fan 186. A coal ash discharge tube 153 is provided on a lower portion of the dust removing chamber 152. The dust removing chamber 152 is capable of performing both a wet dust collection and a dry bag dust collection. Here the wet dust collection is mainly introduced. A sprinkler head 154 is provided above the dust removing chamber 152 in the dust remover shell 151. The dehydrated exhaust gas main outlet pipe 123 is immersed in water in the dust removing chamber 152.

As shown in FIG. 1 and FIG. 2, hot exhaust gas enters the hot exhaust gas main inlet pipe 1251 in the exhaust gas radiator 125 via the hot exhaust gas main inlet pipe 122, and then enters the dehydrated exhaust gas main outlet pipe 123 via the dehydrated exhaust gas outlet pipe 1252 in the exhaust gas radiator 125, and then is cleaned by a water layer of the dust removing chamber 152 and discharged by the chimney 16. Coal ash of the hot exhaust gas remains in the water layer and is discharged by the coal ash discharge tube 153 at regular intervals. The structure is not only capable of cleaning the hot exhaust gas but also reducing discharge temperature of the hot exhaust gas, so as to facilitate air exhaust and protecting the induced draft fine 186 to achieve the object of a clean and environmental protection discharge, so as to meet the requirements of discharging the exhaust gas in environmental friendly manners.

As shown in FIG. 1 and FIG. 2, the hot exhaust gas after burning is at a temperature of 700° C.~800° C. Waste heat of the exhaust gas is utilized to heat the exhaust gas radiator 125, which is capable of not only reducing temperature of hot exhaust gas after burning, so as to perform dehydration on the inputting coal passing through the exhaust gas radiator 125, but also ensuring moisture content of the inputting coal at 1% or below, on such a manner that the hot exhaust gas after burning is effectively utilized and energy consumption is saved.

As shown in FIG. 1 and FIG. 2, an outlet hopper 111 of the bucket elevator 11 is provided above an inlet hopper. The inputting coal conveyor 17 is provided on a bottom of the bunker 14.

Figure 24:
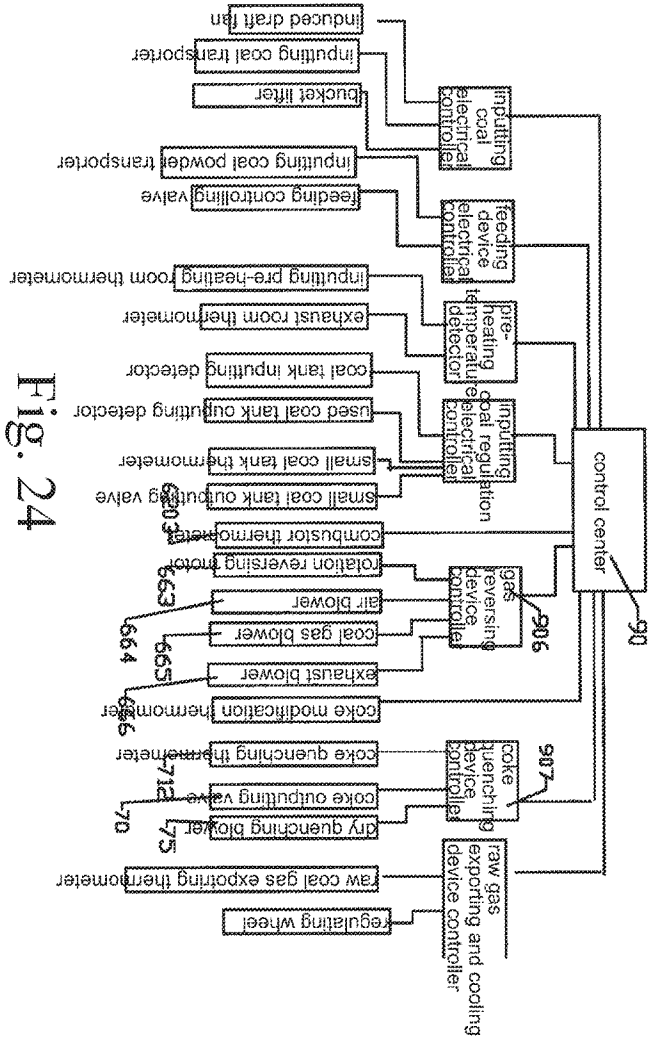
FIG. 24 is a sketch view of electrical connections of an industrial control core of the present invention.

As shown in FIG. 24, the coal pyrolyzing furnace according to the preferred embodiment of the present invention further comprises an industrial control core 90. The industrial control core 90 directly controls the induced draft fine 186, the inputting coal conveyor 17 and the bucket elevator 11 which are electrically connected therewith.

The coal pyrolyzing furnace in the preferred embodiment further comprises an inputting coal electric controller 901 which automatically controls the inputting coal conveyor 17, the induced draft fine 186 and the bucket elevator 11. Further, the inputting coal electric controller 901 is connected with the industrial control core 90, so as to achieve automotive dehydration on the inputting coal. Preferably, from the control principle of electrical control, the inputting coal conveyor 17, the induced draft fine 186 and the bucket elevator 11 can be controlled by the industrial control core 90 as well, so providing the inputting coal electric controller 901 here is not intended to limit the range of the present invention.

Principles of the inputting coal in the preferred embodiment of the present invention are as follows.

1. The industrial control core 90 sends starting signals of the inputting coal conveyor 17, the induced draft fine 186 and the bucket elevator 11 to the inputting coal electric controller 901. Via the bucket elevator 11, the inputting coal according to a certain proportion is sent to the feeding hopper 1241 above the dehydration device shell 121, and the passes through the feeding vibrating screen 1242, the discharge duct 1243, the discharge vibrating screen 1244, the exhaust gas radiator 125 and finally enters the bunker 14.

2. The hot exhaust gas enters the hot exhaust gas main inlet pipe 1251 in the exhaust gas radiator 125 via the hot exhaust gas main inlet pipe 122, then enters the dehydrated exhaust gas main outlet pipe 123 via the dehydrated exhaust gas outlet pipe 1252 in the exhaust gas radiator 125, and then enters the water layer of the dust removing chamber 152 via the induced draft fine 186 to be discharged from the chimney 16.

3. Meanwhile, while the inputting coal drops into the bunker 14 via the exhaust gas radiator 125, air in the dehydration device shell 121 and the bunker 14 are heated by the inputting coal. Heated air enters the exhaust air internal inlet pipe 132 of the coal dust filter 13 under thermal buoyancy thereof (See FIG. 3). Since the entrance of the exhaust air internal inlet pipe 132 is higher that the entrance 1341 of the exhaust air internal outlet pipe 134, hot exhaust gas forms cyclone from top to bottom, and finally is discharged via the metal fiber filter 136 and the exhaust air external outlet pipe 135. Dust in the exhaust gas drops into the dust funnel 133 under blocking of the metal fiber filter 136 to enter the bunker 14.

Part III: Feeding, Pre-Heating, Regulating and Cooling of Inputting Coal

After transporting, a temperature of dehydrated inputting coal usually drops to a room temperature, or even lower. However, during the process of coking, temperatures of the inputting coal are expected to be at a range of 200° C.~300° C., therefore, the inputting coal is pre-heated, regulated and cooled before entering a coking chamber.

Section I: Feeding the Inputting Coal

Figure 5:
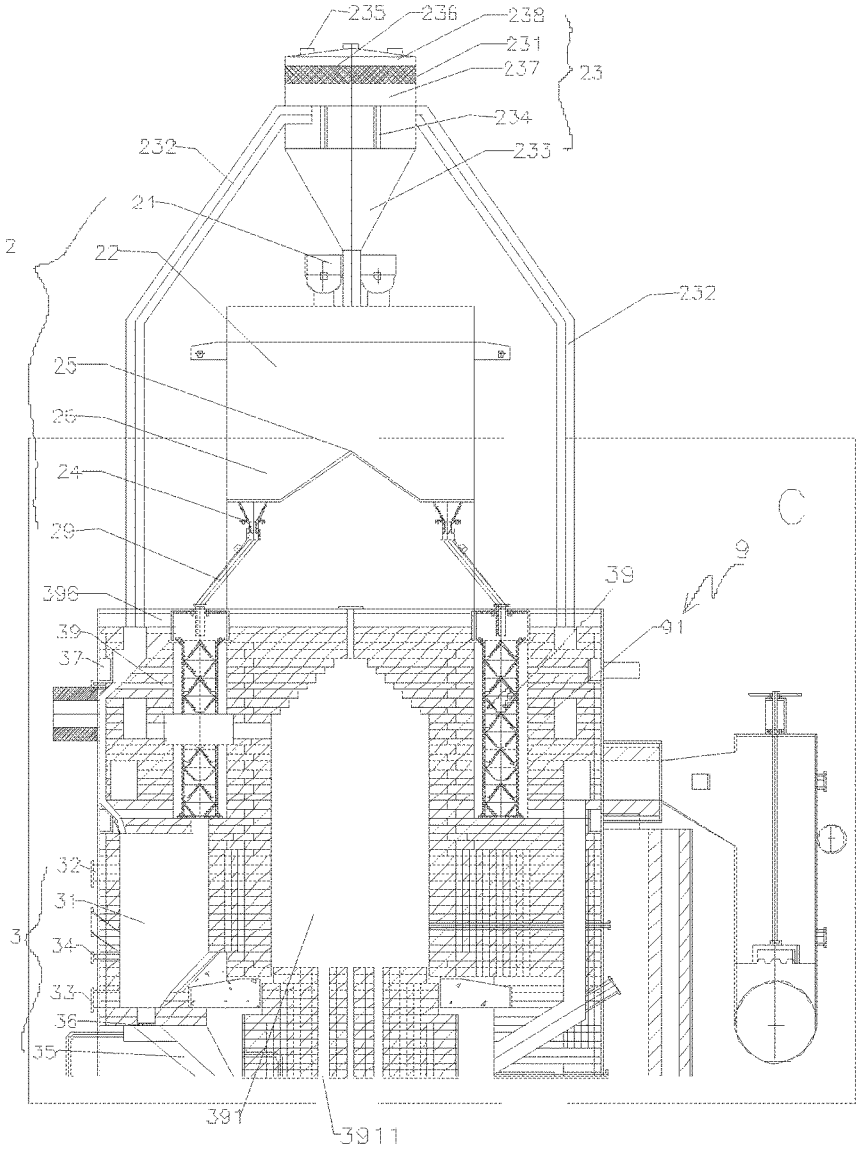
FIG. 5 is a section view of an assemble of a pre-heating device and an inputting coal feeding device. (which is also an enlarged view of B in FIG. 25)

As shown in FIG. 5, a coal feeding device 2 comprises an inputting coal dust conveyor 21, an inputting bunker 22, a coal dust direction divider 25, a coal dust distribution chamber 26, an inputting bunker discharge duct 29 and a coal dust filter 23.

As shown in FIG. 5, the inputting coal dust conveyor 21 adopts a screw conveying structure and is provided on a top of the inputting bunker 22. The convex coal dust direction divider 25 is provided on a middle of a bottom of the inputting coal bunker 22 and divides the bottom of the inputting bunker 22 into a plurality of coal dust distribution chambers 26. In the preferred embodiment 8 coal dust distribution chambers 26 are provided in total. The inputting bunker discharge duct 29 is connected with a bottom of the coal dust distribution chambers 26, and a discharge control valve 24 is provided on the inputting bunker discharge duct 29.

Figure 4:
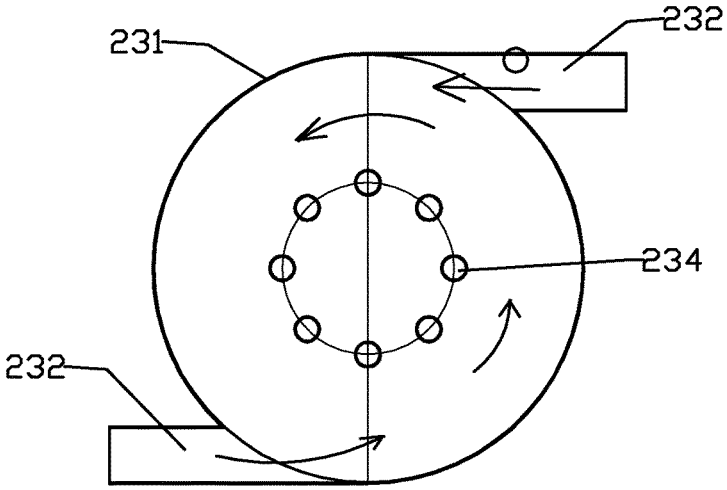
FIG. 4 is a top view of the coal dust filter according to a second preferred embodiment of the present invention.

As shown in FIG. 4 and FIG. 5, the coal dust filter 23, which almost has an identical structure with the coal dust filter 13 in the Part 2, is provide above the inputting bunker 22. The coal dust filter 23 comprises: a filter shell 231, an exhaust air internal inlet pipe 232, a dust funnel 233, an exhaust air internal outlet pipe 234 and an exhaust air external outlet pipe 235. The exhaust air internal inlet pipe 232 is provided on a periphery of the filter shell 231. The dust funnel 233 is provided in the filter shell 231 and extends to the inputting bunker 22. The exhaust air internal outlet pipe 234 is provided above the dust funnel 233. An entrance of the exhaust air external inlet pipe 232 is higher than an entrance of the exhaust air internal outlet pipe 234. The exhaust air internal inlet pipe 232 has a vertical included angle with the exhaust air internal outlet pipe 234 to form a cyclone structure in the filter shell 231. The exhaust air internal outlet pipe 234 is provided on an internal header 237 in the filter. The exhaust air external outlet pipe 235 is provided on a filter external header 238. A metal fiber filter 236 is provided between the filter internal header 237 and the filter external cover 238.

In addition, as shown in FIG. 24, the coal pyrolyzing furnace according to the preferred embodiment of the present invention further comprises a coal feeding device electric controller 902 which controls the inputting coal dust conveyor 21 and the discharge control valve 24. Further, coal feeding device electric controller 902 is connected with the industrial control core 90. Preferably, from the control principle of electrical control, the inputting coal dust conveyor 21 and the discharge control valve 24 can be directly controlled by the industrial control core 90 as well, so providing the coal feeding device electric controller 902 here is not intended to limit the range of the present invention.

Section II: Pre-Heating the Inputting Coal

Figure 6:
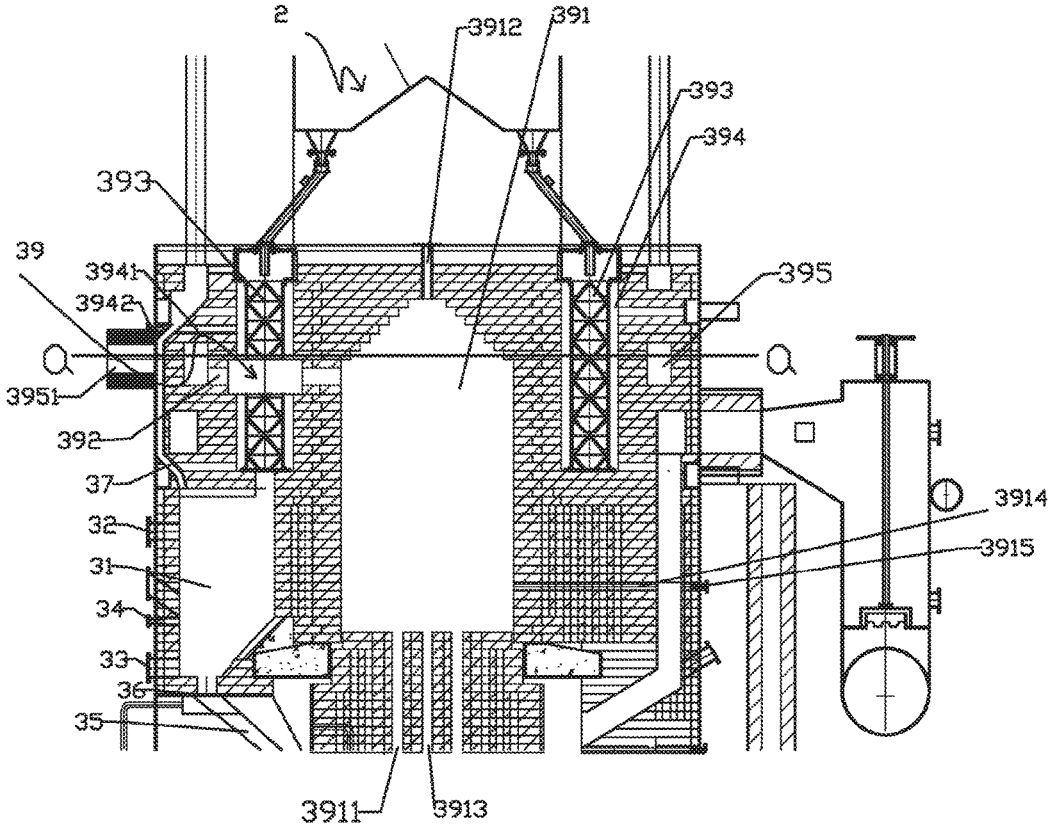
FIG. 6 is an enlarged view of C in FIG. 5.

As shown in FIG. 5 and FIG. 6, a preheating device 39 is provided below the coal feeding device 2 and on a top of a coal pyrolyzing furnace 9.

Figure 7:
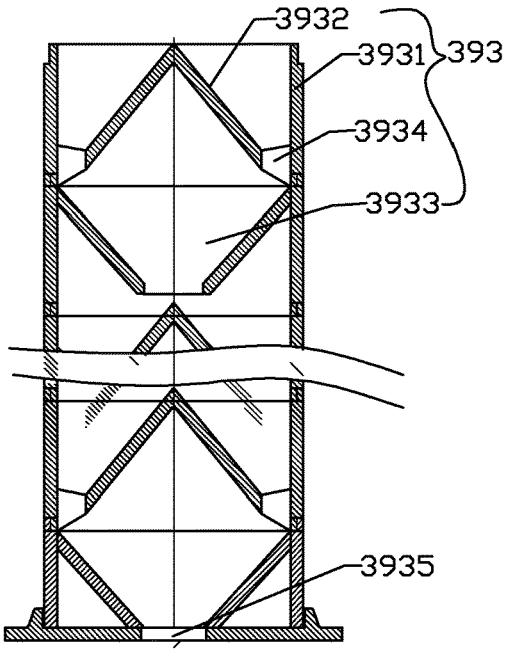
FIG. 7 is a sectional view of the pre-heater of the coal preheating device of the present invention.
Figure 8:
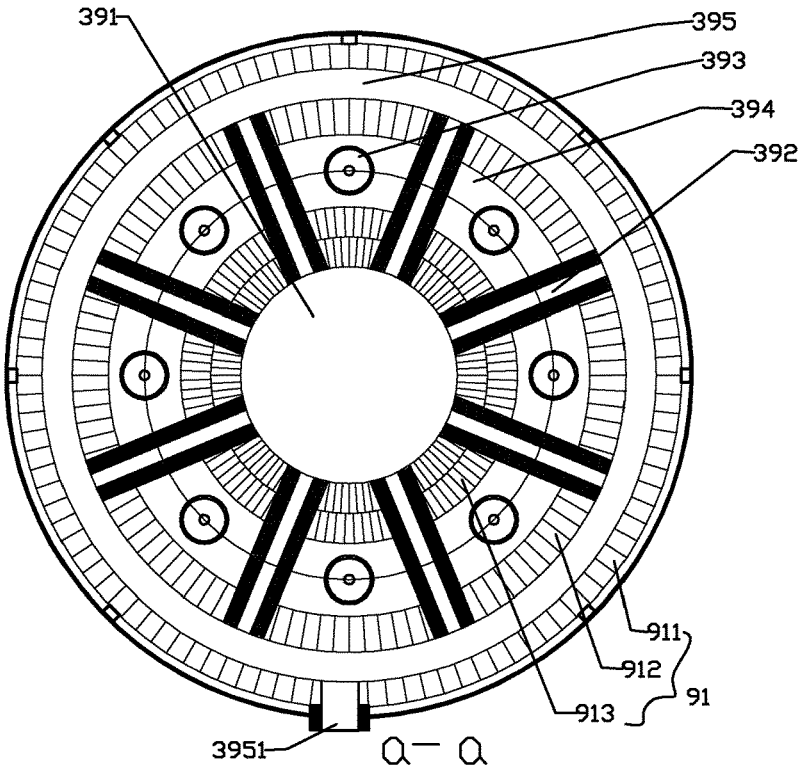
FIG. 8 is a sectional view of a-a in FIG. 6.

As shown in FIGS. 6-8, the preheating device 39 comprises a furnace body 91, an exhaust gas chamber 391, at least one exhaust gas preheating pipe 392 and a preheater 393;

wherein the furnace body 91 comprises an internal layer wall 913, a middle layer wall 912 and an external layer wall 911 (see FIG. 8);

the internal layer wall 913 forms the exhaust gas chamber 391, and an exhaust gas gathering loop channel 395 is formed between the middle layer wall 912 and the external layer wall 911.

The exhaust gas gathering loop channel 395 has an exhaust gas main outlet 3951. The exhaust gas preheating pipe 392 passes through the internal layer wall 913, the middle layer wall 912 and the external layer wall 911 to be communicated with the exhaust gas gathering loop channel 395, and divides a position between the internal layer wall 913 and the middle layer wall 912 into a plurality of preheating chamber 394. As shown in FIG. 8, in the preferred embodiment, 8 preheating chamber 394 are divided by the 8 exhaust gas preheating pipes 392. The preheaters 393 are respectively provided in each of the preheating chambers 394.

The preheater 393 is in a cylinder shape and made of steel. The preheater 393 comprises a barrel 3931, a conical direction divider 3932, an open funnel 3933 and a preheating coal discharge duct 3934. The conical direction divider 3932 and the open funnel 3933 are distributed in groups from top to bottom, so as to facilitate uniformly preheating of a coal furnace.

As shown in FIG. 6, the furnace body 91 has a preheating chamber thermometer hole 3941. A preheating chamber thermometer 3942 is provided on an exit of the preheating chamber thermometer hole 3941 for monitoring temperature changes in the preheating chamber 394. An exhaust gas chamber thermometer hole 3914 is provided on the furnace body 91. An exhaust gas chamber thermometer 3915 is provided on an exit of the exhaust gas chamber thermometer hole 3914 for monitoring temperature changes of the exhaust gas chamber 391. In addition, an upper sight hole 3912 is provided on a top of the waste gas chamber 391; and a lower sight hole 3913 is provided on a bottom of the exhaust gas chamber 391, so as to facilitate observing working conditions at a lower portion of the waste gas chamber 391 and the coal pyrolyzing furnace 9 by technicians.

As shown in FIG. 5 and FIG. 6, a preheating exhaust gas discharge pipe 396 is provided in the preheating chamber 394. The preheating exhaust gas discharge pipe 396 extends to an exhaust gas external inputting through pipe 232 of the coal dust filter 23. Hot exhaust gas with dust on an upper portion of the preheating chamber 394 is discharged to the exhaust gas external inputting through pipe 232, so as to facilitate dropping the inputting coal of the inputting bunker 22 into the preheating chamber 394 for preheating.

As shown in FIG. 5, FIG. 6 and FIG. 8, a hot exhaust gas inputting pipe 3911 is provided on a bottom of the exhaust gas chamber 391. Hot exhaust gas after burning enters the hot exhaust gas inputting pipe 3911, accesses the exhaust gas gathering loop channel 395 via exhaust gas preheating pipe 392, and finally is discharged via an exhaust gas main outlet 3951 of the exhaust gas gathering loop channel 395. Hot exhaust gas after burning performs heat conduction on the exhaust gas preheating pipe 392, the internal layer wall 913 and the middle layer wall 912 during the process of discharging. The special structure design of the preheating device 39 is as follows. The hot exhaust gas after burning discharged by the exhaust gas chamber 391 is utilized for heating air in the preheating chamber 394, so as to achieve objects of heating the inputting coal dropping into the preheating device 393, decreasing temperature of hot exhaust gas after burning discharged from the exhaust gas chamber 391 without consuming extra energy, in such a manner that afterheat of the hot exhaust gas after burning is utilized.

In addition, as shown in FIG. 24, according to the preferred embodiment of the present invention, preheating temperature monitor 903 has temperature data for monitoring the preheating chamber thermometer 3942 and the exhaust gas chamber thermometer 3915. The preheating temperature monitor 903 is connected with the industrial control core 90. Of course, according to the principle of electric control, the preheating chamber thermometer 3942 and the exhaust gas chamber thermometer 3915 according to the preferred embodiment can also be monitored directly by the industrial control core 90, so the preheating temperature monitor 903 provided here is not intended to limit the scope of the preferred embodiment.

Section III: Regulation of Pre-Heated Inputting Coal

As shown in FIG. 5 and FIG. 6, an inputting coal regulating bunker 3 is provided on the furnace body 91 below the preheating device 393 and on a peripheral of the exhaust gas chamber 391. The inputting coal regulating bunker 3 comprises: a small bunker 31, a bunker feeding level indicator 32, a bunker discharging level indicator 33, a small bunker thermometer 34, a small bunker discharging pipe 35 and a small bunker discharging valve 36.

As shown in FIG. 5 and FIG. 6, a top portion of the small bunker 31 is connected with a bottom portion of the preheating device 393. The bunker feeding level indicator 32 and the bunker discharging level indicator 33 are respectively provided on a top and a bottom of the small bunker 31. The small bunker thermometer 34 is provided on a middle portion of the small bunker 31. The small bunker discharging pipe 35 is connected on a bottom of the small bunker 31 via the small bunker discharging valve 36 and extends to a coal pyrolyzing furnace coking chamber 61. (See FIG. 9).

Furthermore, as shown in FIG. 24, according to the preferred embodiment of the present invention, the coal pyrolyzing furnace further comprises an inputting coal electric controller 904 for collecting signals of the bunker feeding level indicator 32, the bunker discharging level indicator 33 and the small bunker thermometer 34, and for automatically controlling on-off of the small bunker discharging valve 36. The inputting coal electric controller 904 is connected with the industrial control core 90. Of course, from the principle of electric control, level signals of the bunker feeding level indicator 32 and the bunker discharging level indicator 33 and temperature signals of the small bunker thermometer 34 can also be directly collected by the industrial control core 90 as well. The on-off of the small bunker discharging valve 36 can be directly controlled by the industrial control core 90. Thus, providing the inputting coal electric controller 904 here is not intended to limit the scope of the preferred embodiment.

Method of regulating the inputting coal according to the preferred embodiment is as follows.

1. The preheated inputting coal is pre-stored in the small bunker 31. When the coal pyrolyzing furnace coking chamber 61 needs adding coal, the industrial control core 90 turns on the small bunker discharging valve 36 to add coal to the coal pyrolyzing furnace coking chamber 61.

2. When addition of the coal needs to be stopped, the industrial control core 90 turns off the small bunker discharging valve 36 to terminate adding coal to the coal pyrolyzing furnace coking chamber 61.

3. When the bunker discharging level indicator 33 detects the amount of coal in the small bunker 31 is insufficient, the industrial control core 90 turns on the discharge control valve 24 to add coal to the small bunker 31. When the bunker feeding level indicator 32 detects the amount of coal in the small bunker 31 is enough, the industrial control core 90 turns off the discharge control valve 24 to stop adding coal to the small bunker 31, so as to regulate the inputting coal of the coal pyrolyzing furnace coking chamber 61.

As shown in FIG. 5 and FIG. 6, a small bunker hot exhaust gas discharge pipe 37 is provided on an upper portion of the small bunker 31. The small bunker hot exhaust gas discharge pipe 37 extends to the exhaust gas external inputting through pipe 232 of the coal dust filter 23, so that hot exhaust gas on an upper portion of the small bunker 31 is capable of being discharged to the exhaust gas external inputting through pipe 232, which facilitates adding coal to the small bunker 31 smoothly.

Section IV: Cooling of Inputting Coal Before Entering Coking Chamber

Figure 9:
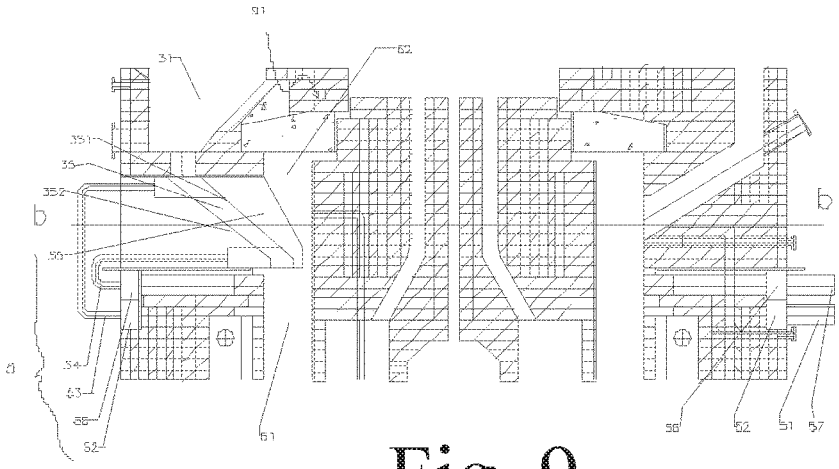
FIG. 9 is a sketch view of an inputting coal cooling device of the present invention. (which is also an enlarged view of G in FIG. 25)

As shown in FIG. 9, when the small bunker discharging pipe 35 is feeding coal to the coal pyrolyzing furnace coking chamber 61, a large amount of raw gas generated in the process of coal pyrolyzing exists in a top portion of the coal pyrolyzing furnace coking chamber 61, high temperature of the raw gas performs heat conduction on a body of the small bunker discharging pipe 35 and the furnace body 91, so that the inputting coal is easy caking in the small bunker discharging pipe 35, which hinders feeding coal to the coal pyrolyzing furnace coking chamber 61, and thus the inputting coal requires cooling.

Figure 10:
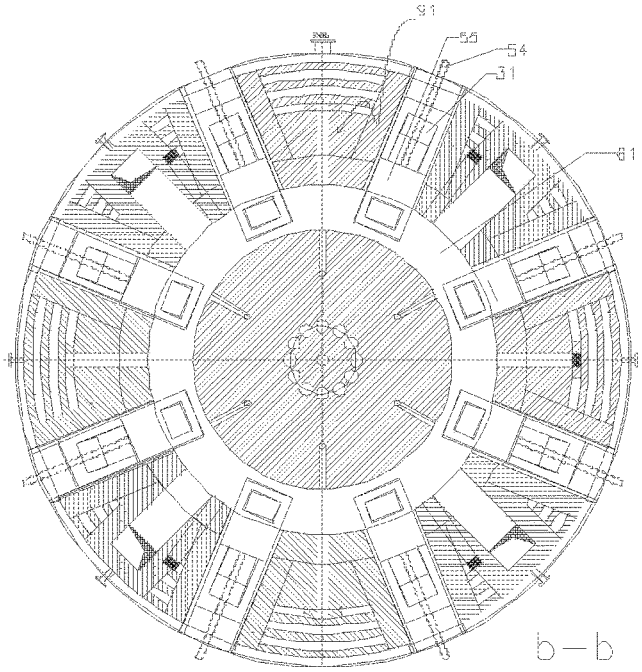
FIG. 10 is a sectional view of b-b in FIG. 9.

As shown in FIG. 9 and FIG. 10, the inputting coal cooling device 5 comprises: an air inlet pipe 57, an air outlet pipe 51, an air inlet loop pipe 56, an air outlet loop pipe 52, an air inlet branch pipe 54, an air outlet branch pipe 53 and a cooling air duct 55;

wherein the air inlet pipe 57, the air inlet loop pipe 56 and the air outlet pipe 51 are communicated with the air outlet loop pipe 52;

the air inlet loop pipe 56 and the air outlet loop pipe 52 are respectively provided on a periphery of the furnace body 91;

the air inlet branch pipe 54 and the air outlet branch pipe 53 are respectively provided on the air inlet loop pipe 56 and the air outlet loop pipe 52;

wherein the air inlet branch pipe 54 is provided on a lower portion of the cooling air duct 55, and the air outlet branch pipe 53 is provided on an upper portion of the cooling air duct 55;

the small bunker discharging pipe 35 passes through the cooling air duct 55 and extends to the coal pyrolyzing furnace coking chamber 61.

As shown in FIG. 10 and FIG. 9, the furnace body 91 is designed in an annular shape, 8 small bunkers 31 are provided on a periphery of the furnace body 91 to facilitate uniform addition of coal to the periphery of the coking chamber 61, so the amount of the cooling air duct 55 and the small bunker discharging pipe 35 are respectively 8. When air accesses the air inlet loop pipe 56, the air inlet branch pipe 54 and the cooling air duct 55 in sequence from the air inlet pipe 57, and then is discharged from the air outlet branch pipe 53, the air outlet loop pipe 52 and the air outlet pipe 51. The inputting coal in the small bunker discharging pipe 35 is cooled by the cooling air duct 55, so as to effectively prevent caking of the inputting coal in the small bunker discharging pipe 35, in such a manner that putting coal to the coal pyrolyzing furnace coking chamber 61 smoothly is achieved.

In addition, an internal side of the small bunker discharging pipe 35 which is close to the coal pyrolyzing furnace coking chamber 61 is greatly influenced by the heat of the raw gas, so an internal side wall 351 of the small bunker discharging pipe 35 is provided in the cooling air duct 55, and an external side wall 352 of the small bunker discharging pipe 35 is exposed in the air and is cooled by natural air, so as to reduce the amount of air blowing into the cooling air duct 55 to save energy.

Part IV: Pyrolysis of Inputting Coal (Carbonizing Heating, Coke Modification and Dry Quenching)

Section I: Pyrolyzing, Carbonizing and Heating of Inputting Coal

Figure 12:
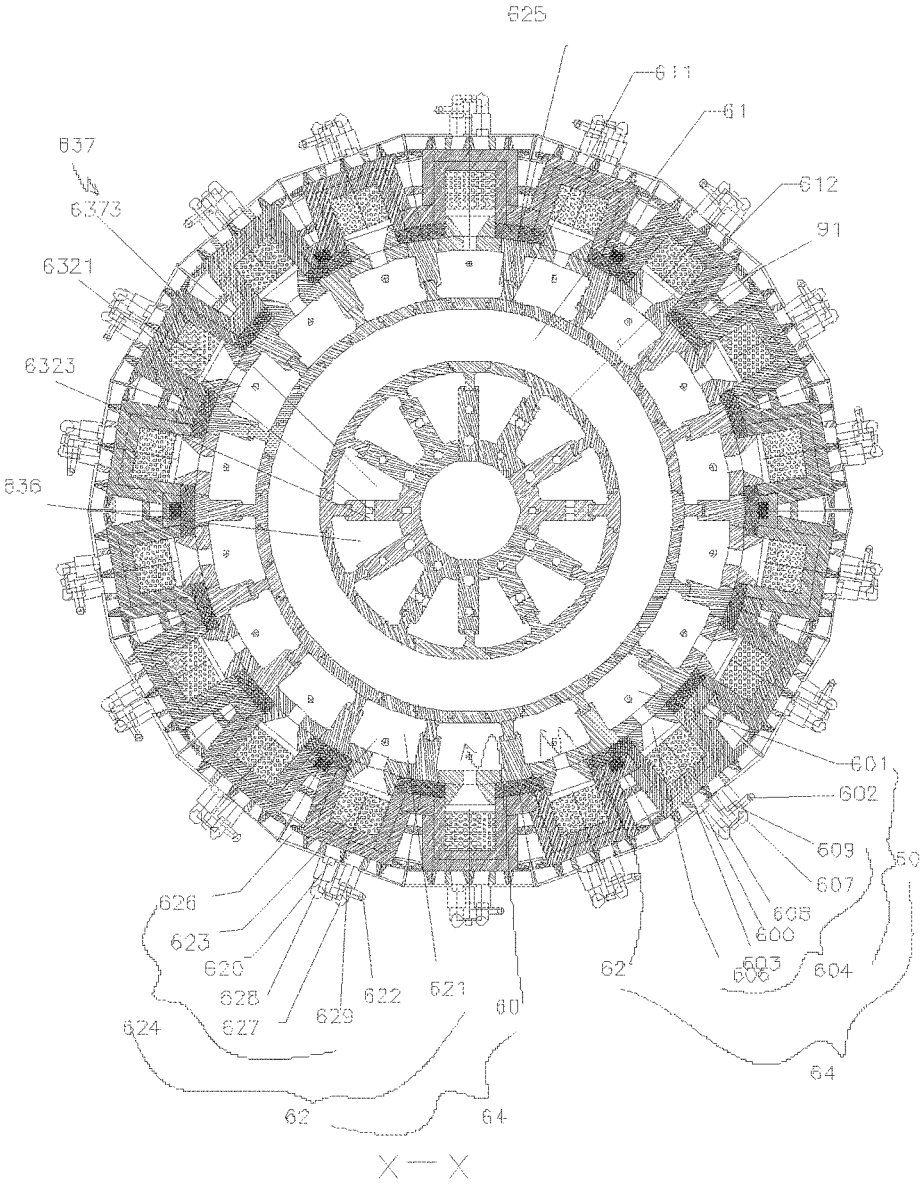
FIG. 12 is a sectional view of x-x in FIG. 11.
Figure 25:
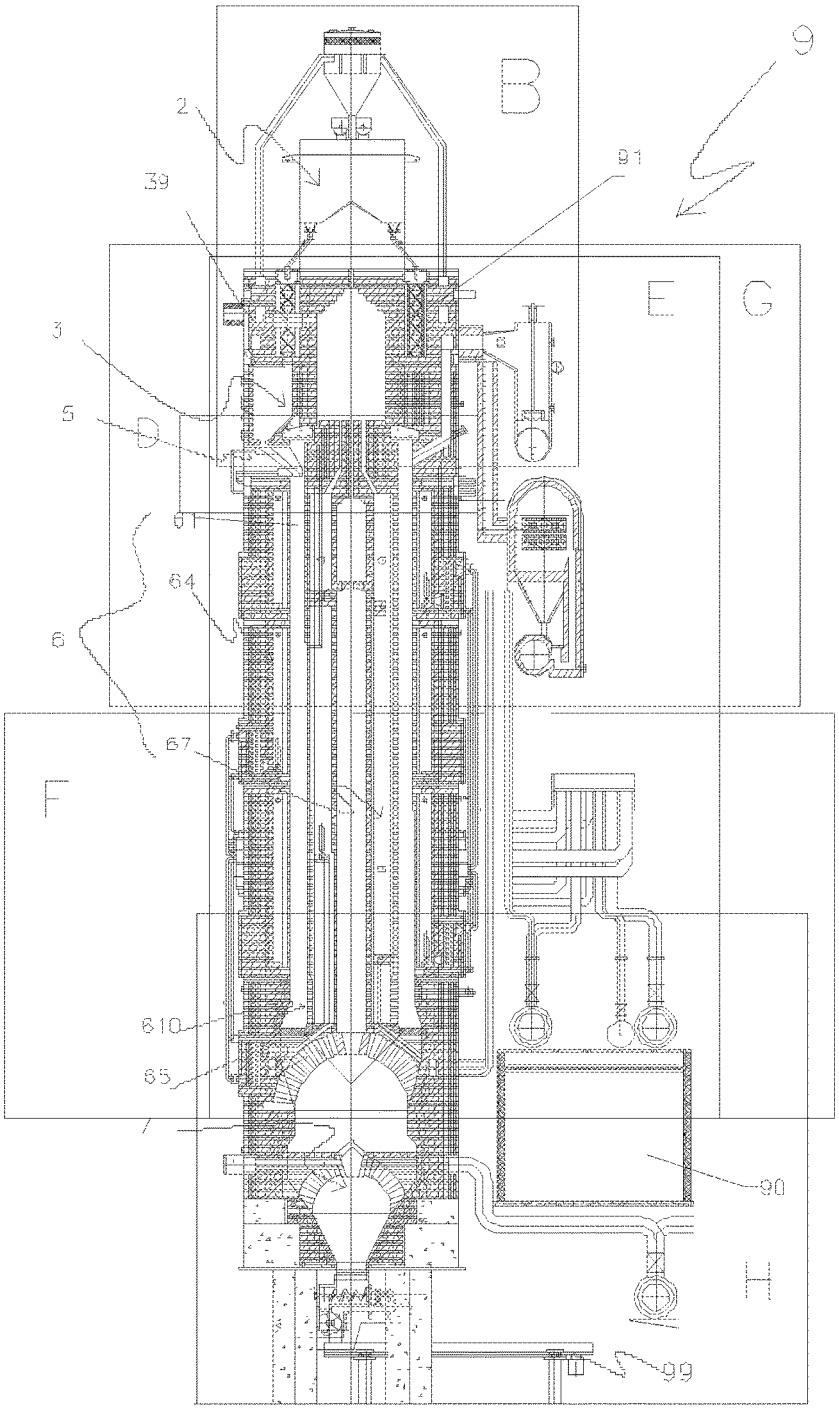
FIG. 25 is an overall sketch view of the coal pyrolyzing furnace of the present invention.

Referring to FIG. 25, a coal pyrolyzing and carbonizing device 6 is arranged in a center of a furnace body 91, which comprises: a coking chamber 61, an external gas heating device 64, an internal burning heating device 67 and a flame path arch 65. Referring to FIG. 12, the coking chamber 61 is in a loop chamber above the flame path arch, the loop chamber is formed by an internal loop wall 612 and an external loop wall 611 made of fire-resistant and heat-conductive materials; the external gas heating device 64 is around an external circle of the external loop wall 611 of the coking chamber 61, wherein the external gas heating device 64 comprises a plurality of equal sets (9 sets according to the preferred embodiment) of a first gas heater 62, a second gas heater 60 and a gas reversing device 66. In addition, referring to FIG. 25, because of a high temperature of the coking chamber 61, the external gas heating device 64 heats with an upper heating section, a middle heating section and a lower heating section, and each heating section comprises 9 sets of the first gas heating devices 62 and the second gas heaters 60 with same structures.

Figure 16:
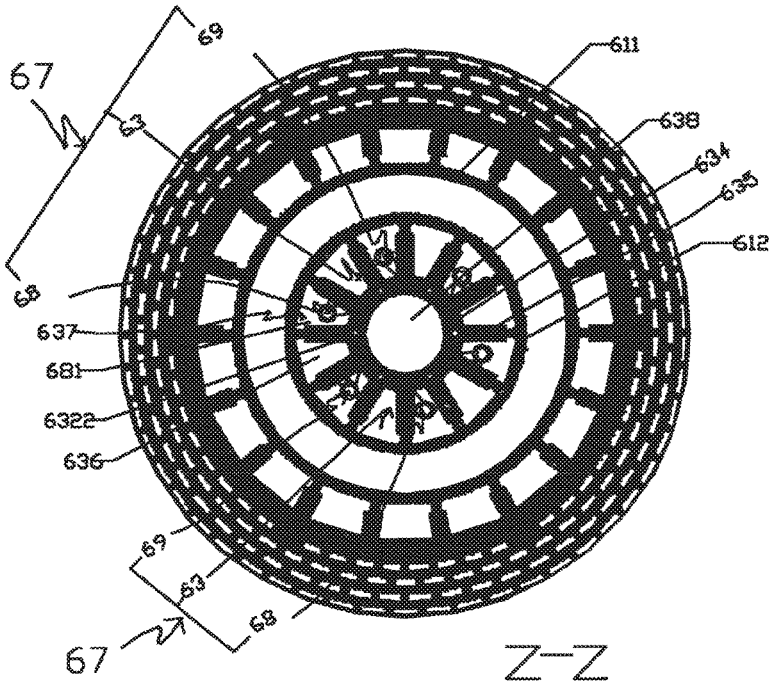
FIG. 16 is a sectional view of z-z of FIG. 21.

Referring to FIG. 16, the internal burning heating device 67 is inside the internal loop wall 612 of the coking chamber 61, wherein the internal burning heating device 67 comprises a plurality of equal sets (3 sets according to the preferred embodiment) of a third gas heater 68, a fourth gas heater 69 and a coke quenching exhaust heater 63.

Figure 11:
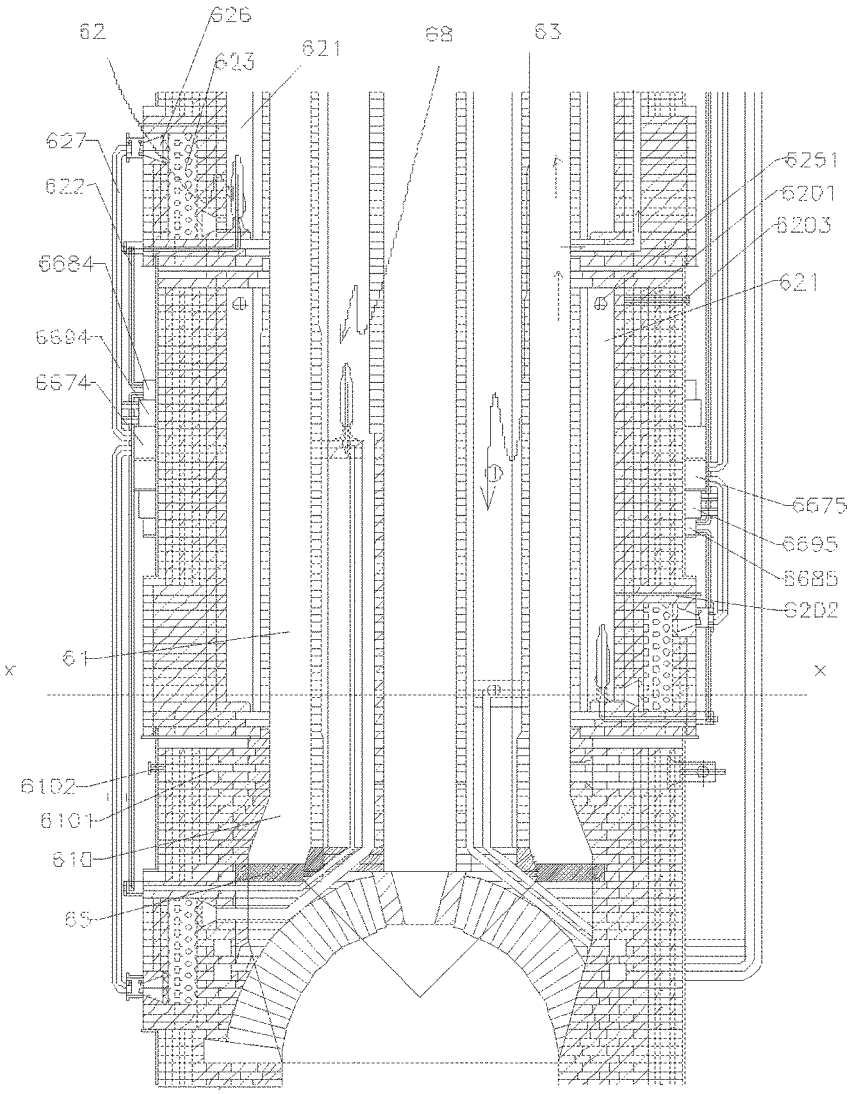
FIG. 11 is an enlarged view of F in FIG. 25.

Referring to FIG. 11 and FIG. 12, the first gas heater 62 comprises a first combustor 621, a first coal gas inputting sub-tube 622 and a first storing heat exchanger 624.

Referring to FIG. 11 and FIG. 12, the first combustor 621 has a relatively closed coal gas burning flame path formed by an external wall of the furnace body 91 which is made of fire-resistant materials, the external loop wall 611 of the coking chamber made of fire-resistant and heat-conductive materials, and an external flame path isolating wall 625. Referring to FIG. 1, the first coal gas inputting sub-tube 622 passes through the external wall of the furnace body 91 and reaches a bottom of the first combustor 621.

Referring to FIG. 11 and FIG. 12, the first storing heat exchanger 624 comprises a first heat storing chamber 626, a first heat storing body 623, a first air inputting sub-tube 627 and a first exhaust outputting sub-tube 628, wherein the first heat storing chamber 626 is inside the external wall of the furnace body 91, the first heat storing body 623 is inside the first heat storing chamber 626, a first end of the first heat storing chamber 626 communicates with the bottom of the first combustor 621, a second end of the first heat storing chamber 626 is connected to the first air inputting sub-tube 627 and the first exhaust outputting sub-tube 628.

Figure 13:
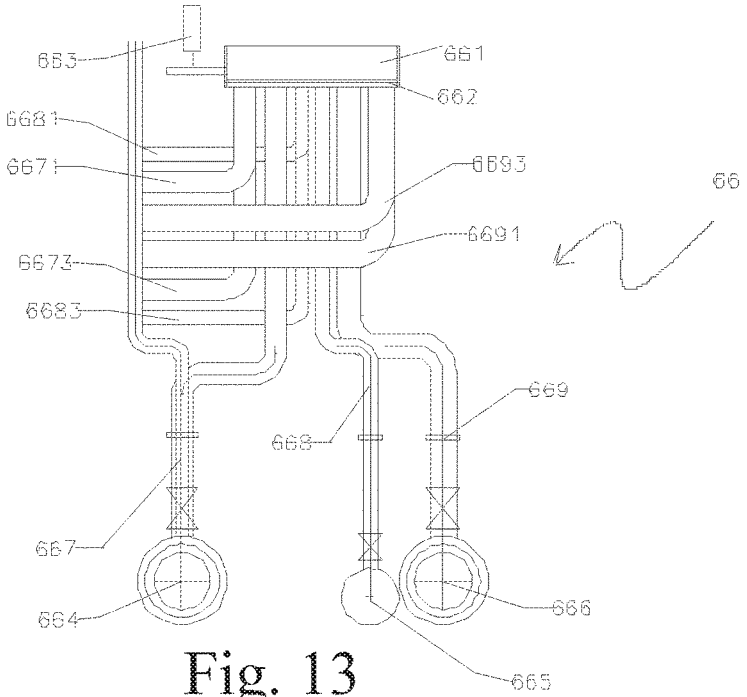
FIG. 13 is a sketch view of a gas inverting device of the present invention.

Referring to FIGS. 12-13, a first one-way air valve 629 is arranged between the first air inputting sub-tube 627 and the first heat storing chamber 626, wherein the first one-way air valve enables air to enter the first combustor 621 from the first air inputting sub-tube 627 and the first heat storing chamber 626; a first one-way exhaust valve 620 is arranged between the first exhaust outputting sub-tube 628 and the first heat storing chamber 626, wherein the first one-way exhaust valve 620 enables waste gas produced by coal gas combustion to flow from the first combustor 621, pass through the first heat storing chamber 626, and finally be outputted from the first exhaust outputting sub-tube 628 (Of course, by utilizing the following gas reversing device 66, wherein an air main tube 667 communicates with a first air sub-tube 6671, and the air main-tube 667 is cut off from a second air sub-tube 6673; while an exhaust main-tube 669 is cut off from a first exhaust sub-tube 6691, and the exhaust main-tube 669 communicates with a second exhaust sub-tube 6693, functions of the first one-way air valve 629 and the first one-way exhaust valve 620 are able to be substituted).

Similarly, referring to FIG. 12, the second gas heater 60 comprises a second combustor 601, a second coal gas inputting sub-tube 602 and a second storing heat exchanger 604. The second combustor 601 has a relatively closed coal gas burning flame path formed by the external wall of the furnace body 91 which is made of fire-resistant materials, the external loop wall 611 of the coking chamber made of fire-resistant and heat-conductive materials, and the external flame path isolating wall 625. The second coal gas inputting sub-tube 602 passes through the external wall of the furnace body 91 and reaches the second combustor 601.

Referring to FIG. 12 and FIG. 13, the second storing heat exchanger 604 comprises a second heat storing chamber 606, a second heat storing body 603, a second air inputting sub-tube 607 and a second exhaust outputting sub-tube 608, wherein the second heat storing chamber 606 is inside the external wall of the furnace body 91, the second heat storing body 603 is inside the second heat storing chamber 606; a first end of the second heat storing chamber 606 communicates with a bottom of the second combustor 601, a second end of the second heat storing chamber 606 is connected to the second air inputting sub-tube 607 and the second exhaust outputting sub-tube 608. A second one-way air valve 609 is arranged between the second air inputting sub-tube 607 and the second heat storing chamber 606, wherein the second one-way air valve 609 enables air to enter the second combustor 601 from the second air inputting sub-tube 607 and the second heat storing chamber 606; a second one-way exhaust valve 600 is arranged between the second exhaust outputting sub-tube 608 and the second heat storing chamber 606, wherein the second one-way exhaust valve 600 enables waste gas produced by coal gas combustion to flow from the second combustor 601, pass through the second heat storing chamber 606, and finally be outputted from the second exhaust outputting sub-tube 608 (Of course, by utilizing the following gas reversing device 66, wherein the air main tube 667 is cut off from the first air sub-tube 6671, and the air main-tube 667 communicates with the second air sub-tube 6673; while the exhaust main-tube 669 communicates with the first exhaust sub-tube 6691, and the exhaust main-tube 669 is cut off from the second exhaust sub-tube 6693, functions of the second one-way air valve 609 and the second one-way exhaust valve 600 are able to be substituted).

Referring to FIG. 11 and FIG. 12, a combustor through-hole 6251 is drilled at a top of the external flame path isolating wall 625 between the first combustor 621 and the adjacent second combustor 601. The combustor through-hole 6251 connects the first combustor 621 and the adjacent second combustor 601 for forming an associated set. According to the preferred embodiment, 18 external flame path isolating walls 625 are provided on the external gas heating device 64 for forming 9 associated burning sets; in addition, referring to FIG. 25, because of a high temperature of the coking chamber 61, the external gas heating device 64 heats with the upper heating section, the middle heating section and the lower heating section, and each heating section comprises 9 sets of the first gas heating devices 62 and the second gas heaters 60 with same structures.

In summary, gas heating and storing heat exchanging are:

1) when burning the coal gas in the first combustor 621, clean coal gas obtained by purifying and recycling raw gas enters the first combustor 621 through the first coal gas inputting sub-tube 622, and the first one-way air valve 629 is open for enabling air to enter the first combustor 621 through the first air inputting sub-tube 627 and the first heat storing chamber 626; the first one-way exhaust valve 620 is closed; after hot exhaust generated enters the second combustor 601 through the combustor through-hole 6251, and the hot exhaust passes through the second heat storing body 603 of the second heat storing chamber 606, the second heat storing body 603 cools the hot exhaust, then the hot exhaust becomes low-temperature exhaust with a relatively low temperature and is outputted from the second exhaust outputting sub-tube 608;

2) when burning the coal gas in the second combustor 601, the clean coal gas obtained by purifying and recycling raw gas enters the second combustor 601 through the second coal gas inputting sub-tube 602, and the second one-way air valve 609 is open for enabling the air to enter the second combustor 601 through the second air inputting sub-tube 607 and the second heat storing chamber 606, wherein the air is heated by the second heat storing body 603 and becomes hot air for supporting coal gas combustion in the second combustor 601; meanwhile, the second one-way exhaust valve 600 is closed; after hot exhaust generated during combust of the coal gas in the second combustor 601 enters the first combustor 621 through the combustor through-hole 6251, and the hot exhaust passes through the first heat storing body 623 in the first heat storing chamber 626, the first heat storing body 623 cools the hot exhaust, then the hot exhaust becomes low-temperature exhaust with a relatively low temperature and is outputted from the first exhaust outputting sub-tube 628; and 3) similarly, 1) and 2) are alternatively repeated.

Referring to FIG. 11, a combustor temperature observing hole 6201 and a combustor observing hole 6202 are drilled on the external wall of the furnace body 91, wherein the combustor observing hole 6202 is conducive to visually observing each combustor; a combustor thermometer 6203 is provided in the combustor temperature observing hole 6201 for detecting a temperature of the combustor, so as to assess a coal pyrolyzing process.

Referring to FIG. 24, the combustor thermometer 6203 is connected to a control center 90, and the control center 90 automatically collects temperature data from the combustor thermometer 6203.

Figure 14:
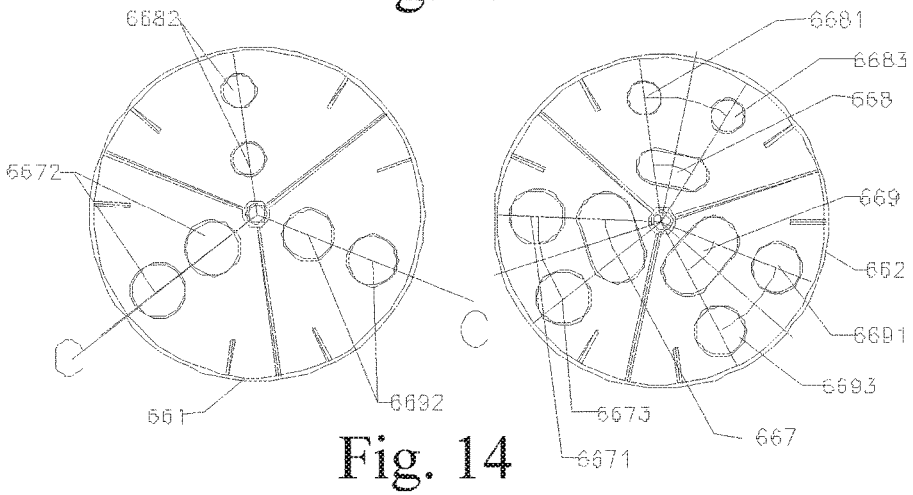
FIG. 14 is a sketch view of an upper plate and a lower plate of the gas inverting device of the present invention.
Figure 15:
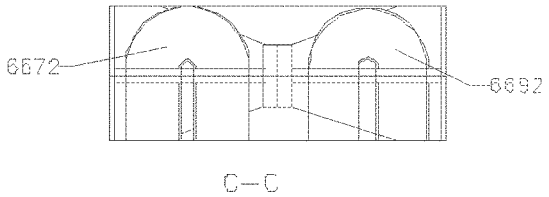
FIG. 15 is a sectional view of c-c in FIG. 14.
Figures 1, 15:
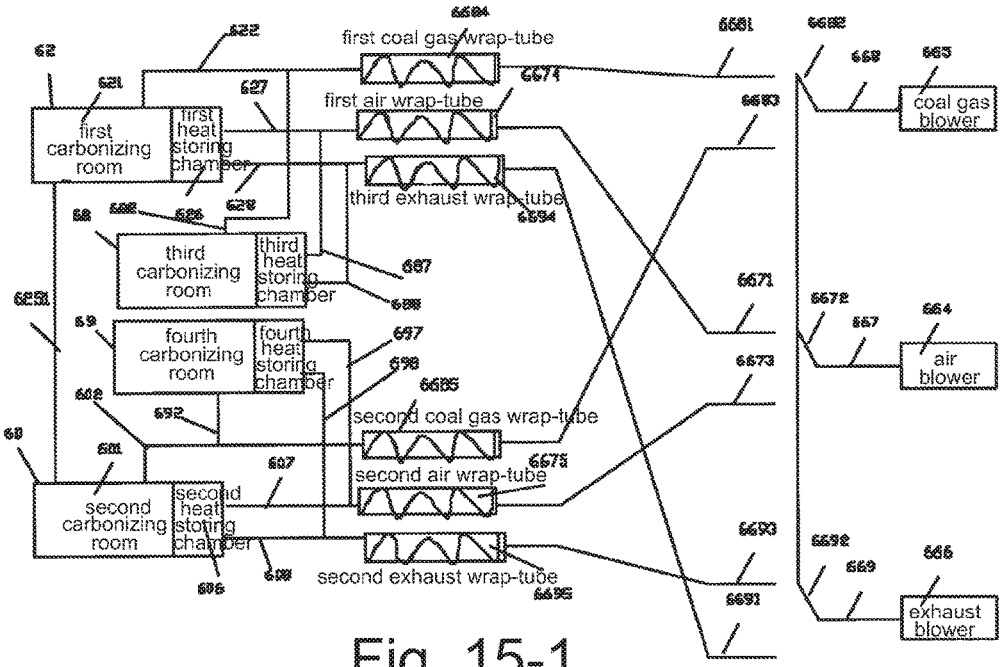

Referring to FIG. 13, FIG. 15 and FIG. 15-1, the gas reversing device 66 comprises an upper disk 661, a lower disk 662, a rotation reversing motor 663, an air blower 664, a coal gas blower 665, and an exhaust blower 666, wherein the lower disk 662 is respectively connected to an air main-tube 667, a first air sub-tube 6671, a second air sub-tube 6673, a coal gas main-tube 668, a first coal gas sub-tube 6681, a second coal gas sub-tube 6683, an exhaust main-tube 669, a second exhaust sub-tube 6693 and a first exhaust sub-tube 6691, wherein arrangement of the second exhaust sub-tube 6693 and the first exhaust sub-tube 6691 is opposite to arrangement of the first air sub-tube 6671 and said second air sub-tube 6673 as well as arrangement of the first coal gas sub-tube 6681 and the second coal gas sub-tube 6683 (as shown in FIG. 14 and FIG. 15-1).

Referring to FIG. 13, FIG. 15 and FIG. 15-1, the upper disk 661 is attached on the lower disk 662; an air communicating tube 6672, a coal gas communicating tube 6682 and an exhaust communicating tube 6692 are respectively connected to the upper disk 661; the rotating reversing motor 663 drives the upper disk 661 to rotate back and forth on the lower disk 662 for continuously connecting and disconnecting the air main-tube 667 with the first air sub-tube 6671 and the second air sub-tube 6673, continuously connecting and disconnecting the coal gas main-tube 668 with first coal gas sub-tube 6681 and the second coal gas sub-tube 6683, and continuously connecting and disconnecting the exhaust main-tube 669 with the second exhaust sub-tube 6693 and the first exhaust sub-tube 6691 (wherein switch of the first air sub-tube 6671 and the second air sub-tube 6673, and the switch of the first coal gas sub-tube 6681 and the second coal gas sub-tube 6683 are opposite).

Referring to FIG. 11 and FIG. 15-1, two sets of wrap-tubes are provided at the peripheral of the furnace body 91, comprise a first air wrap-tube 6674, a first coal gas wrap-tube 6684, a first exhaust wrap-tube 6694; a second air wrap-tube 6675, a second coal gas wrap-tube 6685 and a second exhaust wrap-tube 6695.

Referring to FIG. 15-1, the first air wrap-tube 6674 connects the first air sub-tube 6671 to the first air inputting sub-tube 627, in such a manner that a tunnel is formed with the first air sub-tube 6671, the first air wrap-tube 6674, the first air inputting sub-tube 627, the first heat storing chamber 626 and the first combustor 621; meanwhile, the first coal gas wrap-tube 6684 connects the first coal gas sub-tube 6681 to the first coal gas inputting sub-tube 622, in such a manner that a tunnel is formed with the first coal gas sub-tube 6681, the first coal gas wrap-tube 6684, the first coal gas inputting sub-tube 622 and the first combustor 621; meanwhile, the first exhaust wrap-tube 6694 connects the first exhaust sub-tube 6691 to the first exhaust outputting sub-tube 628, in such a manner that a tunnel is formed with the first exhaust sub-tube 6691, the first exhaust outputting sub-tube 628, the first heat storing chamber 626 and the first combustor 621; and similarly, the second air wrap-tube 6675 connects the second air sub-tube 6673 to the second air inputting sub-tube 607, in such a manner that a tunnel is formed with the second air sub-tube 6673, the second air wrap-tube 6675, the second air inputting sub-tube 607, the second heat storing chamber 606 and the second combustor 601; meanwhile, the second coal gas wrap-tube 6685 connects the second coal gas sub-tube 6683 to the second coal gas inputting sub-tube 602, in such a manner that a tunnel is formed with the second coal gas sub-tube 6683, the second coal gas wrap-tube 6685, the second coal gas inputting sub-tube 602 and the second combustor 601; meanwhile, the second exhaust wrap-tube 6695 connects the second exhaust sub-tube 6693 to the second exhaust outputting sub-tube 608, in such a manner that a tunnel is formed with the second exhaust sub-tube 6693, the second exhaust outputting sub-tube 608, the second heat storing chamber 606 and the second combustor 601.

In addition, referring to FIG. 24, the preferred embodiment further comprises a gas reversing controller 906 for controlling the rotation reversing motor 663, the air blower 664, the coal gas blower 665 and the exhaust blower 666. The gas reversing controller 906 is inferiorly connected to the control center 90. Of course, according to electrical control principle, the rotation reversing motor 663, the air blower 664, the coal gas blower 665 and the exhaust blower 666 may be directly controlled by the control center 90, and the gas reversing controller 906 is not a limit of the preferred embodiment.

Referring to FIG. 11, FIG. 15-1 and FIGS. 12-15, a heating method of the external gas heating device 64 comprises steps of:

(1) driving the upper disk 661 to rotate on the lower disk 662 by the rotation reversing motor 663 of the gas reversing device 66, connecting the air main-tube 667 to the first air sub-tube 6671, and cutting off the air main-tube 667 from the second air sub-tube 6673; meanwhile, connecting the coal gas main-tube 668 to the first coal gas sub-tube 6681, and cutting off the coal gas main-tube 668 from the second coal gas sub-tube 6683; meanwhile, cutting off the exhaust main-tube 669 from the first exhaust sub-tube 6691, and connecting the exhaust main-tube 669 to the second exhaust sub-tube 6693;

(2) blowing the air into the air main-tube 667 by the air blower 664, wherein the air passes through the air communicating tube 6672, the first air sub-tube 6671, the first air wrap-tube 6674 and the first air inputting sub-tube 627 in sequence for entering the first heat storing chamber 626; heating the air with the first heat storing body 623 before the air enters the first combustor 621; meanwhile, blowing the clean coal gas obtained by purifying and recycling the raw gas into the coal gas main-tube 668 by the coal gas blower 665, wherein the coal gas passes through the coal gas communicating tube 6682, the first coal gas sub-tube 6681, the first coal gas wrap-tube 6684 and the first coal gas inputting sub-tube 622 in sequence for entering the first combustor 621 to burn; wherein because the exhaust main-tube 669 is cut off from the first exhaust sub-tube 6691, and correspondingly, the exhaust main-tube 669 communicates with the second exhaust sub-tube 6693, exhaust generated by burning the coal gas in the first combustor 621 is only able to enter the second combustor 601 through the combustor through-hole 6251 at the top of the external flame path isolating wall 625, and then be cooled by the second heat storing body 603 of the second heat storing chamber 606 before being outputted by the exhaust blower 666 through the second exhaust outputting sub-tube 608, the second exhaust wrap-tube 6695, the second exhaust sub-tube 6693 and the exhaust main-tube 669;

(3) after burning for a while, driving the upper disk 661 to reversely rotate on the lower disk 662 by the rotation reversing motor 663 of the gas reversing device 66, cutting off the air main-tube 667 from the first air sub-tube 6671, and connecting the air main-tube 667 to the second air sub-tube 6673; meanwhile, cutting off the coal gas main-tube 668 from the first coal gas sub-tube 6681, and connecting the coal gas main-tube 668 to the second coal gas sub-tube 6683; meanwhile, connecting the exhaust main-tube 669 to the first exhaust sub-tube 6691, and cutting off the exhaust main-tube 669 from the second exhaust sub-tube 6693; and (4) blowing the air into the air main-tube 667 by the air blower 664, wherein the air passes through the air communicating tube 6672, the second air sub-tube 6673, the second air wrap-tube 6675 and the second air inputting sub-tube 607 in sequence for entering the second heat storing chamber 606; heating the air with the second heat storing body 603 of the second heat storing chamber 606 before the air enters the second combustor 601; meanwhile, blowing the clean coal gas obtained by purifying and recycling the raw gas into the coal gas main-tube 668 by the coal gas blower 665, wherein the coal gas passes through the coal gas communicating tube 6682, the second coal gas sub-tube 6683, the second coal gas wrap-tube 6685 and the second coal gas inputting sub-tube 602 for entering the second combustor 601 to burn; wherein because the exhaust main-tube 669 communicates with the first exhaust sub-tube 6691, and correspondingly, the exhaust main-tube 669 is cut off from the second exhaust sub-tube 6693, exhaust generated by burning the coal gas in the second combustor 601 is only able to enter the first combustor 621 through the combustor through-hole 6251 at the top of the external flame path isolating wall 625, and then be cooled by the first heat storing body 623 of the first heat storing chamber 626 before being outputted by the exhaust blower 666 through the first exhaust outputting sub-tube 628, the first exhaust wrap-tube 6694, the first exhaust sub-tube 6691 and the exhaust main-tube 669.

Therefore, the combustion principle of the external gas heating device 64 is that: when the waste gas in the first combustor 621 produced by coal gas combustion enters into the second combustor 601 via the combustor through-hole 6251, the residual heat of the waste gas is absorbed and cooled via the second combustor 601 and the second heat storing body 603 in the second heat storing chamber 606 for being outputted.

Contrarily, when the waste gas in the second combustor 601 produced by coal gas combustion enters into the first combustor 621 via the combustor through-hole 6251, the residual heat of the waste gas is absorbed and cooled via the first combustor 621 and the first heat storing body 623 in the first heat storing chamber 626 for being outputted.

All in all, by the working mode that the gas in the gas reversing device is inputted twice and outputted once, and the working mode that the storing heat exchanger stores and exchanges the heat, the alternating combustion of two sets of gas heaters is achieved; that is to say, that the gas reversing device sends the air and clean gas into the combustor of the first gas heater 62 for combustion, simultaneously, absorbs the combusted hot waste gas from the combustor of the second gas heater 60, the hot waste gas becomes the low temperature waste gas with a relatively low temperature by the heat absorption and temperature reducing via the second heat storing body 603 in the second storing heat exchanger 604 of the second gas heater 60 to be outputted; similarly, the gas reversing device sends the air and clean gas into the combustor of the second gas heater 60 for combustion, simultaneously, absorbs the combusted hot waste gas from the combustor of the first gas heater 62, the hot waste gas becomes the low temperature waste gas with a relatively low temperature by the heat absorption and temperature reducing via the first heat storing body 623 in the first storing heat exchanger 624 of the first gas heater 62 to be outputted. The method mentioned above uses the residual heat of the waste gas after gas combustion with each other to heat the air, which not only sufficiently utilizes the residual heat of the waste gas after gas combustion to improve the combustion efficiency of the gas in the combustor, but reduces the temperature of the waste gas after gas combustion to some extent, no foreign energy is consumed, thus energy saving and consumption reduction is achieved and coking cost is decreased.

As shown in FIG. 11, figure and FIG. 15-1, FIG. 12~15 and FIG. 24, an automotive heating control method of the external combustion gas heating device 64 comprises steps of:

(1) controlling center on the starter rotating commutator motor 663 90 90 662 on the lower rotating, the air director in charge of 6671 through to 667 and the first air, air at 667 and the second in charge of the air 6673 in cutting condition; At the same time, the gas at 668 and the first gas in charge of 6681 also connected, gas in charge of 668 and the second gas in charge of 6683 in cutting condition; At the same time, the combustion gas at 669 and the first combustion exhaust gas in charge of 6691 also cut off, and the corresponding exhaust head of 669 and the second combustion exhaust gas in charge of 6693 in the phase switching state;

(2)) starting the air blower fan, exhaust fan 665 industrial control center, 664, 90;

wherein an air fan will air blowing air at 667, 664 in turn into the air after 6672, the first connecting pipe air in 6671, the first air tube around 6674, the first air into the manifold first regenerative chamber into the 627 to 626, using the first regenerator after the 623 release of the heat to heat the air to enter the first combustor in 621; At the same time, the waste gas fan 665 gas recovery after purification to obtain clean gas blowing head 668 gas, coal gas, in turn, into the gas connecting pipe 6682, the first gas in 6681, the first gas tube around 6684, the first gas into the manifold 622 to enter the first chamber combustion in 621, at the same time, because of the exhaust gas at 669 and the first combustion exhaust gas in charge of 6691 is in phase to cut off the state, and the corresponding gas at 669 and the second combustion exhaust gas in charge of the phase through to 6693, so the first exhaust gas burned in the combustion chamber of 621 can only through the fire partition 625 upper chamber hole into the second chamber (6251) and attempted (601), after the second regenerative chamber in 606, after the second second regenerator regenerative chamber of 606 606 for heat and cooling from the second combustion exhaust gas discharge tubes after 608, the second combustion exhaust pipe around 6695, the second combustion exhaust gas in charge of the 6693, burning exhaust through the exhaust fan 666 head 669;

(3) setting the burning time, industrial centers on the starter rotating commutator motor 663 90 90 662 on the lower reverse rotation, director in charge of 667 and the first air 667 to cut off the air, the air director in charge of 6673 in 667 and the second air on state, at the same time, the head of 668 and the first gas in charge of 6681 also cut off the gas, gas in charge of 668 and the second gas in charge of 6683 on state, at the same time, the waste gas at 669 and the first combustion exhaust gas in charge of the phase through to 6691, and the corresponding gas at 669 and the second combustion exhaust gas in charge of the state of 6693 also is cut off;

(4) blowing the air fan will air 664 to 667, the air entering through the air in turn connecting pipe 6672, the second air in 6673, the second air tube around 6675, the second air into the manifold 607 into the second heat accumulation cavity 606, using the second regenerative chamber in 606 the second regenerator after the 603 release of the heat to heat the air entering the second combustor in 601; Fan 665 at the same time, the gas will get after waste gas after recycling net net gas blowing gas at 668, 6682, the second gas gas in turn into gas connecting pipe for 6683, the second gas tube around 6685, the second gas into branch 602 into the second combustion chamber for combustion in 601, with the the same time, because the combustion exhaust gas head and the first combustion exhaust gas in charge of 6691 through to 669, and the corresponding gas at 669 and the second combustion exhaust gas in charge of 6693 is in phase cut off state, so the exhaust gas burned in the combustion chamber of 601 can only through the fire partition 625 upper chamber hole into the first chamber 621, 6251 and 626, after the first heat storage chamber (the) first regenerative chamber in 626 first regenerator endothermic cooling after 603, the last from the first combustion exhaust gas discharge pipe 628, the first combustion exhaust pipe around 6694, the first combustion exhaust gas in charge of the 6691, combustion exhaust through the exhaust fan 666 head 669.

By automatically controlling heating of the external combustion gas heating device 64, labor cost is reduced, controlling precision of the coal pyrolyzing process is improved, and automation is achieved.

Referring to FIGS. 16 and 25, the internal burning heating device 67 comprises a plurality of sets (three sets are embodied in this example) of third gas heaters 68, fourth gas heaters 69 and coke quenching exhaust heaters 63 which have same structures.

Figure 18:
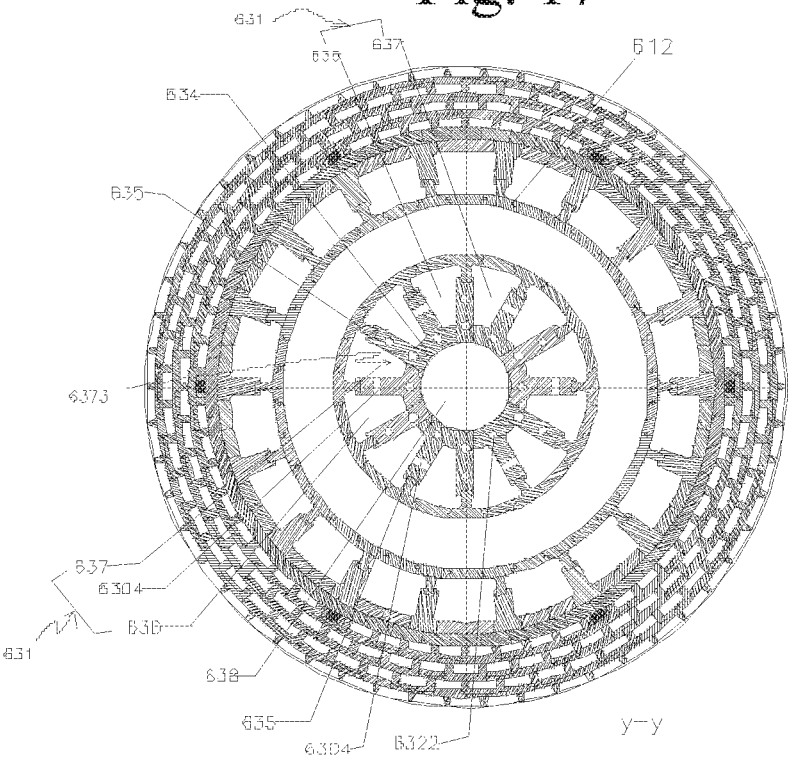
FIG. 18 is a sectional view of y-y of FIG. 21.
Figure 21:
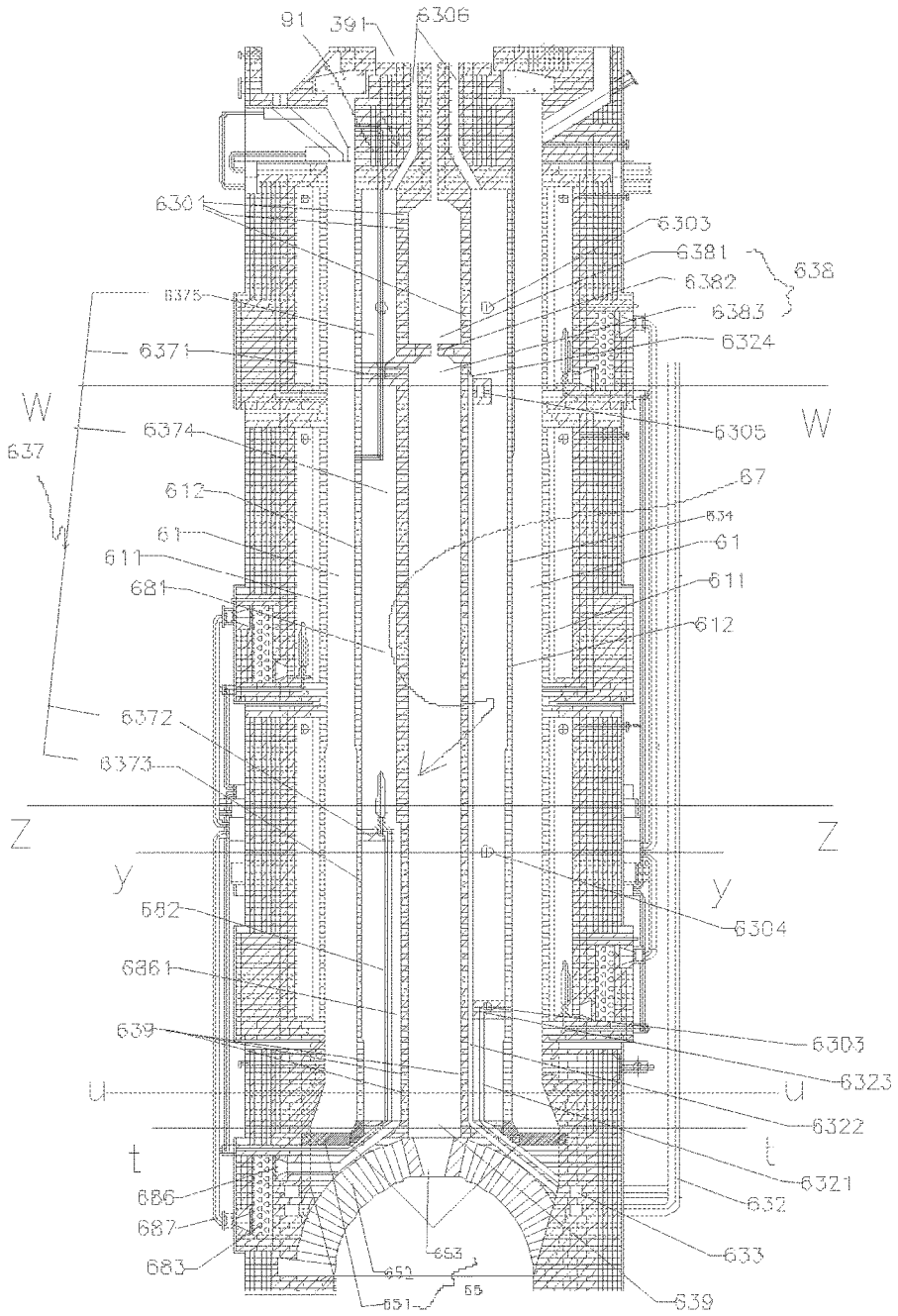
FIG. 21 is a sketch view of a coal pyrolyzation coking device of the present invention. (which is also an enlarged view of E in FIG. 25).

Referring to FIGS. 21 and 18, the coke quenching exhaust heater 63 comprises an internal flame path 631, an air supplement tube 632, a first air supply tube 6321, a second air supply tube 6322, an air supply annular path 633, a central annular wall 634, an internal flame path isolating wall 635, a central path 638, wherein the internal flame path 631 is provided on the flame path arch 65.

As show in FIG. 18, the internal flame path 631 is divided into at least one set of coordinate internal main flame path 636 and internal sub flame path 637 by the internal loop wall 612 of the coking chamber, the central annular wall 634 located within the internal loop wall 612 of the coking chamber and at least one internal flame path isolating wall 635. Referring to FIG. 8, in this example, six internal main flame paths 636 and six internal sub flame paths 637 coordinately form six internal flame paths 631.

As shown in FIG. 21, an upper plugging separating plate 6371 and a lower plugging separating plate 6372 are located within the internal sub flame path 637 to divide the internal sub flame paths 637 into an upper section, a middle section and a lower section, namely, an upper internal sub flame path section 6375, a middle internal sub flame path section 6374 and a lower internal sub flame path section 6373; a waste gas communicating hole 6303 is provided on the internal flame path isolating wall 635 between the upper internal sub flame path section 6375 and the internal main flame path 636, a hot waste gas outputting path 6306 is provided at a top portion of the upper internal sub flame path section 6375 and the internal main flame path 636, the hot waste gas outputting path 6306 is communicated with the waste gas room 391 at an upper portion of the furnace body 91.

As shown in FIGS. 21 and 18, a flame path communicating hole 6304 is provided on the internal flame path isolating wall 635 between the lower internal sub flame path section 6373 and the internal main flame path 636 and is close to a lower portion of the lower plugging separating plate 6372. Referring to FIG. 8, six lower internal sub flame path sections 6373 are respectively communicated with the six internal main flame paths 636 via six flame path communicating holes 6304.

As shown in FIG. 21, the central annular wall 634 defines a central path 638, a path separating plate 6382 is located at a position where the central path 638 is level with the upper plugging separating plate 6371 for dividing the central path 638 into an upper portion and a lower portion, namely, the lower portion forms a high-temperature combustible exhaust inputting path 6383, and the upper portion forms a buffer zone 6381.

Figure 19:
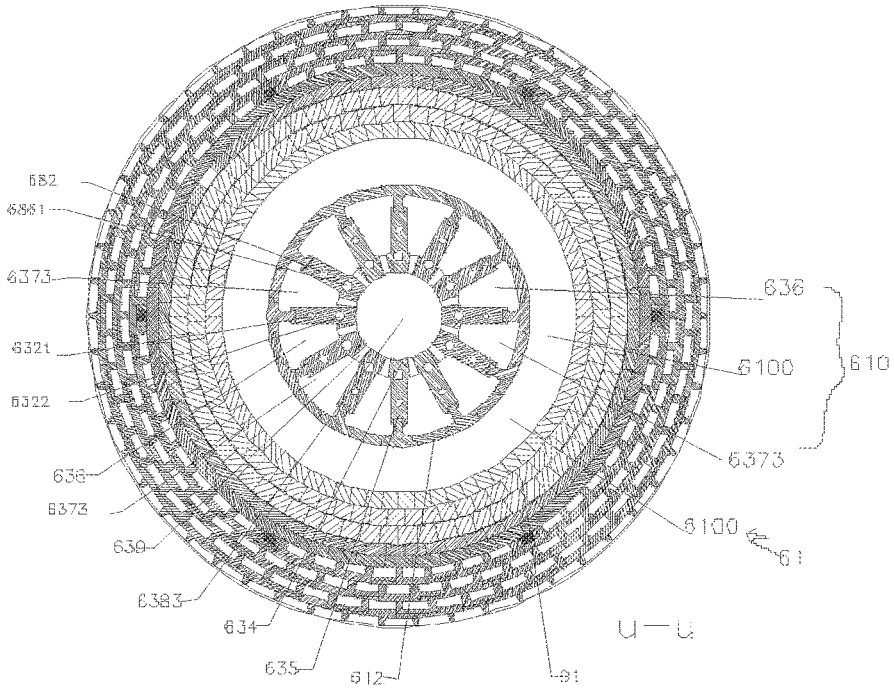
FIG. 19 is a sketch view of a coke modification device of the coal pyrolyzing furnace of the present invention. (which is also a sectional view of u-u in FIG. 21)

As shown in FIGS. 19 and 21, a combustible exhaust inputting hole 639 is provided at a lower portion of the central annular wall 634 for communicating the high-temperature combustible exhaust inputting path 6383 with the internal main flame path 636 and the lower internal sub flame path section 6373, and a waste gas inputting hole 6301 is provided at an upper portion of the central annular wall 634 for communicating the buffer zone 6381 with the internal main flame path 636 and the upper internal sub flame path section 6375.

Figure 20:
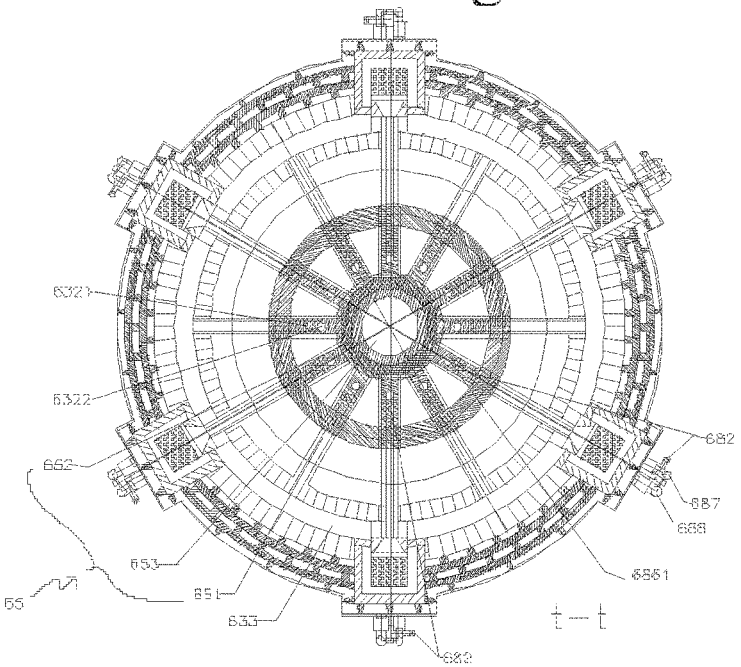
FIG. 20 is a sketch view of a flame path arch of the present invention. (which is also a sectional view of t-t in FIG. 21)

As shown in FIGS. 21, 20 and 19, the air supply annular path 633 is provided on the furnace body 91, the air supplement tube 632 leads to the air supply annular path 633, the first air supply tube 6321 and the second air supply tube 6322 are communicated with the air supply annular path 633, and pass through under a strip arch 651 of the flame path arch 65 and upwardly extend to an interior of the internal flame path isolating wall 635 between the internal main flame path 636 and the internal sub flame path 637.

As shown in FIGS. 21 and 12, the first air supply tube 6321 is located within the internal flame path isolating wall 635 between the internal main flame path 636 and the internal sub flame path 637, a first air supply exit 6323 of the first air supply tube 6321 is located under the lower plugging separating plate 6372 and leads to the internal main flame path 636 and the lower internal sub flame path section 6373. As shown in FIG. 21, the second air supply tube 6322 is also located within the internal flame path isolating wall 635 between the internal main flame path 636 and the internal sub flame path 637, a second air supply exit 6324 of the second air supply tube 6322 is located at a position which is level with or slightly higher than the upper plugging separating plate 6371 and leads to the internal main flame path 636.

Figure 17:
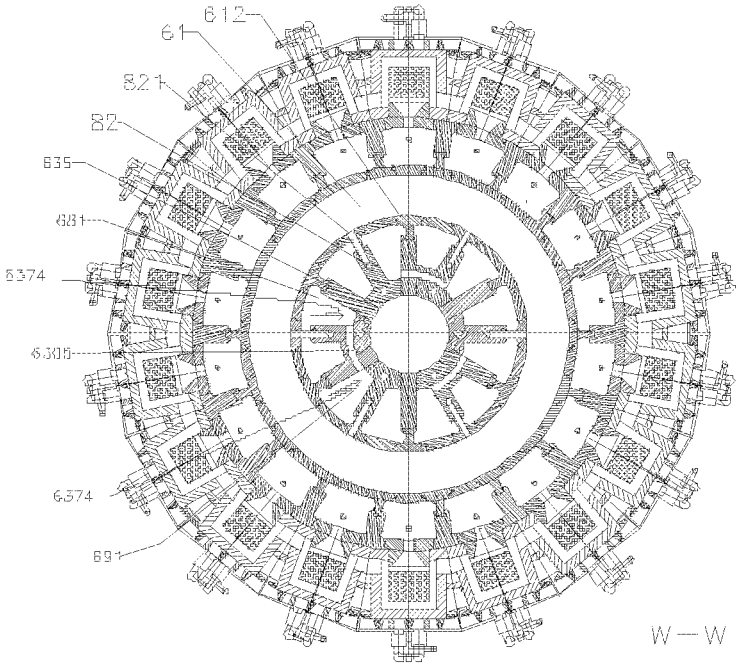
FIG. 17 is a sectional view of w-w of FIG. 21.

As shown in FIGS. 21 and 17, the middle internal sub flame path section 6374 forms a relatively closed independent gas combustor, a previous middle internal sub flame path section 6374 is communicated with an immediately following middle internal sub flame path section 6374 via the combustor path 6305 for defining a related group, the combustor path 6305 is located below the upper plugging separating plate 6371 and passes through the internal main flame path 636 between the previous middle internal sub flame path section 6374 and the immediately following middle internal sub flame path section 6374. Referring to FIG. 17, six middle internal sub flame path sections 6374 are respectively communicated to form three groups via three combustor paths 6305.

As shown in FIGS. 21, 16, 17 and 20, a related set of the third gas heater 68 and the fourth gas heater 69 which has the same structure therewith, are located at two middle internal sub flame path sections 6374 of the internal sub flame path 637 (namely, between the upper plugging separating plate 6371 and the lower plugging separating plate 6372), the structure and combusting principle of the third gas heater 68 and the fourth gas heater 69 are almost identical with those of the first gas heater 62 and the second gas heater 60 mentioned above. The third gas heater 68 comprises the third combustor 681, the third coal gas inputting sub-tube 682, the third heat storing chamber 686, the third heat storing body 683, the third air inputting sub-tube 687 and the third exhaust outputting sub-tube 688.

As shown in FIGS. 21 and 16, it should be noted that the third combustor 681 of the third gas heater 68 is the middle internal sub flame path section 6374, namely, the relatively closed coal gas combustion flame path between the upper plugging separating plate 6371 and the lower plugging separating plate 6372.

As shown in FIGS. 21, 20 and 19, the third coal gas inputting sub-tube 682 passes through under the strip arch 651 of the flame path arch 65 and upwardly extends to the interior of the internal flame path isolating wall 635 for leading to the third combustor 681 (namely, the middle internal sub flame path section 6374), the third heat storing chamber 686 is provided on the furnace body 91 below the strip arch 651, the third heat storing body 683 is located within the third heat storing chamber 686, one end of the third heat storing chamber 686 passes through under the strip arch 651 of the flame path arch 65 via an extending channel 6861, and upwardly extends to the interior of the internal flame path isolating wall 635 for leading to the bottom of the third combustor 681, the other end of the third heat storing chamber 686 is connected with the third air inputting sub-tube 687 and the third exhaust outputting sub-tube 688.

Similarly, the structure of the fourth gas heater 69 is identical with that of the third gas heater 68, it is unnecessary to go into details here. The fourth combustor 691 is communicated with the third combustor 681 via the combustor path 6305 for forming a related group (as shown in FIG. 17).

Referring to FIG. 15-1, the third coal gas inputting sub-tube 682, the third air inputting sub-tube 687 and the third exhaust outputting sub-tube 688 of the third combustor 681 of the third gas heater 68 are respectively communicated with the first coal gas sub-tube 6681, the first air sub-tube 6671 and the first exhaust sub-tube 6691 via the first coal gas wrap-tube 6684, the first air wrap-tube 6674 and the first exhaust wrap-tube 6694.

Referring to FIG. 15-1, the fourth coal gas inputting sub-tube 692, the fourth air inputting sub-tube 697 and the fourth exhaust outputting sub-tube 698 of the fourth combustor 691 of the fourth gas heater 69 are respectively communicated with the second coal gas sub-tube 6683, the second air sub-tube 6673 and the second exhaust sub-tube 6693 via the second coal gas wrap-tube 6685, the second air wrap-tube 6675 and the second exhaust wrap-tube 6695.

All in all, the combustion principle of the third gas heater 68 and the fourth gas heater 69 is almost identical with that of the first gas heater 62 and the second gas heater 60. It is unnecessary to go into details here.

In the present example, the principle of the internal burning heating device 67 is that: the upper internal sub flame path section 6375, the lower internal sub flame path section 6373 and the internal main flame path 636 utilize the high temperature combustible waste gas produced by the dry quenching for air supply combustion heating, and the middle internal sub flame path section 6374 utilizes the clean gas produced by recovering and purifying the raw gas for combustion heating.

In the present example, the working principle of the internal burning heating device 67 is that: (1) when the high temperature combustible waste gas passes through the high temperature combustible waste gas inputting path 6383 below the central path 638, and then enters into the internal main flame path 636 and the lower internal sub flame path section 6373 via the combustible exhaust inputting hole 639, the temperature of the just entered high temperature combustible waste gas is higher and generally in the range of 1000° C.-1100° C., and however, with the working outside and heat dissipation resulted from the rise of the waste gas in the internal main flame path 636 and the lower internal sub flame path section 6373, the temperature will be decreased;

(2) at this time, the air is supplemented to the internal main flame path 636 and the lower internal sub flame path section 6373 via the first air supply tube 6321, so as to allow the high temperature combustible waste gas to obtain the oxygen in the air for combustion, after all, the high temperature combustible gas has a certain amount of the combustible gas, which is not enough to provide the needed heat energy and temperature for the coal pyrolysis of the coking chamber 61;

(3) therefore, when the waste gas, produced by the first air supply combustion of the high temperature combustible waste gas, in the lower internal sub flame path section 6373, comes to the internal main flame path 636 via the flame path communicating hole 6304, and then mixes with the high temperature combustible gas in the internal main flame path 636 and the combusted waste gas for rising in the internal main flame path 636, during the rising process, the mixed high temperature combustible gas and the combusted waste gas provide the heat energy for the coal pyrolysis in the coking chamber 61 via the internal loop wall 612 thereof, the working outside is produced, thus the temperature is gradually decreased;

(4) therefore, the air is needed to be supplemented again to the middle-upper portion of the internal main flame path 636 via the second air supply tube 6322, so as to further combust the mixed high temperature combustible gas and the combusted waste gas, which not only provides the needed heat energy and temperature for the coal pyrolysis in the carbonizing room 61, but sufficiently combust the high temperature combustible gas for improving the work efficiency of the combustion of the high temperature combustible gas;

(5) in addition, due to the buffer zone 6381 between the internal main flame path 636 and the upper internal sub flame path section 6375, the waste gas inputting hole 6301 is provided on the central annular wall 634 for communicating the buffer zone 6381 with the internal main flame path 636 and the upper internal sub flame path section 6375, the waste gas communicating hole 6303 is provided on the internal flame path isolating wall 635 between the internal main flame path 636 and the upper internal sub flame path section 6375, every internal main flame path 636 is completely communicated with the upper internal sub flame path section 6375 for completely mixing the waste gas after the second air supply combustion, the waste gas between the internal main flame path 636 and the upper internal sub flame path section 6375 reaches the uniform temperature and pressure for providing the coal pyrolysis of the upper portion of the coking chamber 61 with the balanced heat energy and temperature;

(6) finally, the waste gas after the second air supply combustion is discharged into the waste gas room 391 on the upper portion of the body of coal pyrolyzing and carbonizing device 91 via the internal main flame path 636 and the hot waste gas discharging path 6306 on the top of the upper internal sub flame path section 6375;

(7) meanwhile, in order to make up for the shortcoming that the combustible gas in the high temperature combustible gas is not enough to provide the needed heat energy and temperature for the coal pyrolysis in the coking chamber 61, and in order to sufficiently utilize the raw gas produced during the coal pyrolysis, the clean gas after recovering and purifying the raw gas is provided for the third combustor 681 of the third gas heater 68 and the fourth combustor 691 of the fourth gas heater 69 to combust, that is to say, that the heating is supplemented in the middle internal sub flame path section 6374, which not only provides enough heat energy and temperature for the coal pyrolysis in the coking chamber 61, but improves the utilization ratio of the raw gas, so that the discharge of the raw gas to the atmosphere is reduced to avoid the air pollution and protect the environment.

Section II: Coke Modification

The coke formed by pyrolysing the coal in the coking chamber has uneven heating and coke particle size, so preferably, the coke is provided with a certain temperature and time for sufficiently contacting among the cokes to transfer the heat, thus the coke modification device 610 is needed.

As shown in FIGS. 22, 21, 19 and 25, the coke modification device 610 is located on the flame path arch 65 within the furnace body, and comprises a coke modification room 6100 formed by the lower portion of the coking chamber 61, the lower portion of the internal main flame path 636, the lower internal sub flame path section 6373, the lower portion of the high temperature combustible waste gas inputting path 6383 of the central path 638 encircled by the central annular wall 634, wherein the combustible exhaust inputting hole 639 is provided on the lower portion of the central annular wall 634 for communicating the high temperature combustible waste gas inputting path 6383 with the internal main flame path 636 and the lower internal sub flame path section 6373.

Furthermore, as shown in FIG. 11, a coke modification temperature observing hole 6101 is provided on the external wall of the furnace body 91, a coke modification thermometer 6102 is located within the coke modification temperature observing hole 6101. Referring to FIG. 24, the control center 90 is electrically connected with the coke modification thermometer 6102 for automatically monitoring the coke modification temperature signal of the coke modification thermometer 6102.

The modification method of the coke modification device is described as follows. The exterior of the coke modification device utilizes the external wall of the body of coal pyrolyzing and carbonizing device, made of heat insulation and refractory material, for heat insulation, and in the interior, the high temperature combustible waste gas enters into the lower portion of the internal main flame path 636 and the lower internal sub flame path section 6373 via the combustible exhaust inputting hole 639, the residual heat of the high temperature combustible waste gas itself is used to provide the needed heat energy and temperature for heat insulation, and especially, it is just right for the just entered high temperature combustible waste gas within the temperature range of 1000° C.-1100° C. to make the coke modification, so as to keep the coke in the coke modification room for a certain time for sufficiently contacting among the coke particles and transferring the heat to equalize the coke particle size.

Section III: Flame Path Arch

As shown in FIGS. 21, 20 and 18, the internal loop wall 612 of the coking chamber and the internal flame path isolating wall 635 and the central annular wall 634 of the internal burning heating device 67 are located within the furnace chamber, so the flame path arch 65 is needed for supporting, simultaneously, the flame path arch 65 also provides the laying of various pipelines for the internal burning heating device 67. Referring to FIGS. 21 and 20, the flame path arch 65 is located within the furnace chamber below the coking chamber 61, the internal burning heating device 67 and the coke modification device 610, and comprises a plurality of strip arches 651, a flame arch central annular wall 652, and a high temperature combustible waste gas path 653 formed in the center of the flame arch central annular wall 652, wherein one end of the strip arch 651 is fixed to the central annular wall 652, the other end of the strip arch 651 is fixed to the furnace body 91, the strip arches 651 surround the center of the central annular wall 652 and are radially arranged at a certain angle. In the present example, an amount of the strip arches 651 is 12, and the amount thereof is the same as the total amount of the internal main flame paths 636 and the internal sub flame paths 637 of the internal burning heating device 67.

As shown in FIGS. 21 and 20, an extending channel 6861 of the third coal gas inputting sub-tube 682 and third heat storing body 686 is provided within a wall body of the strip arch 651, the first air supply tube 6321 and the second air supply tube 6322 are provided within a wall body of another adjacent strip arch 651 to convenient for laying the pipelines of the internal burning heating device 67. Six extending channels 6861 of the third coal gas inputting sub-tube 682 and third heat storing body 686 are respectively provided within the wall bodies of six strip arches 651 in parallel; six first air supply tubes 6321 and six second air supply tubes 6322 are respectively provided in parallel within the wall bodies of another six strip arches 651 for orderly arranging various pipelines of the internal burning heating device 67 without interference.

Section IV: Dry Quenching

The modified coke has a higher temperature, generally, within the range of 1000° C.-1100° C. Therefore, the coke at high temperature needs to be cooled to convenient for transportation and storage, thereby a dry quenching device 7 is needed.

Figure 22:
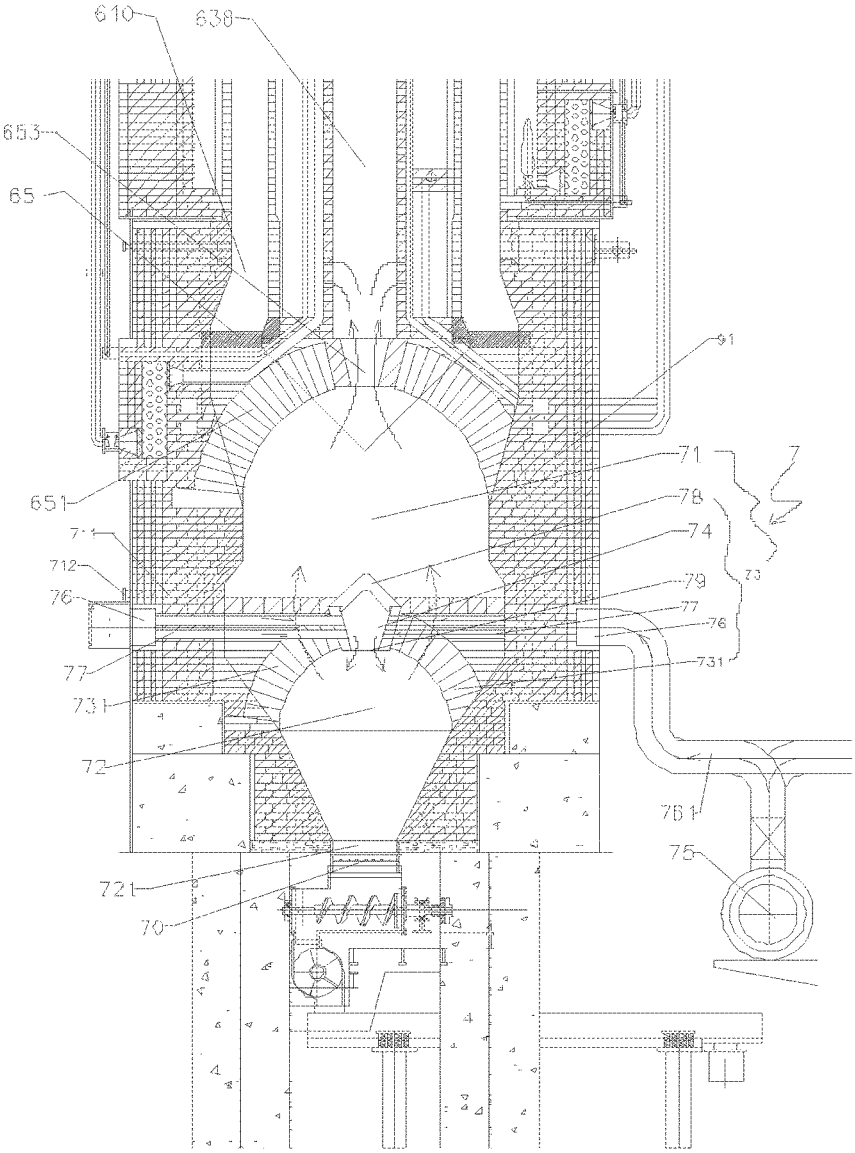
FIG. 22 is a sketch view of a dry quenching device. (which is also an enlarged view of H in FIG. 25).
Figure 23:
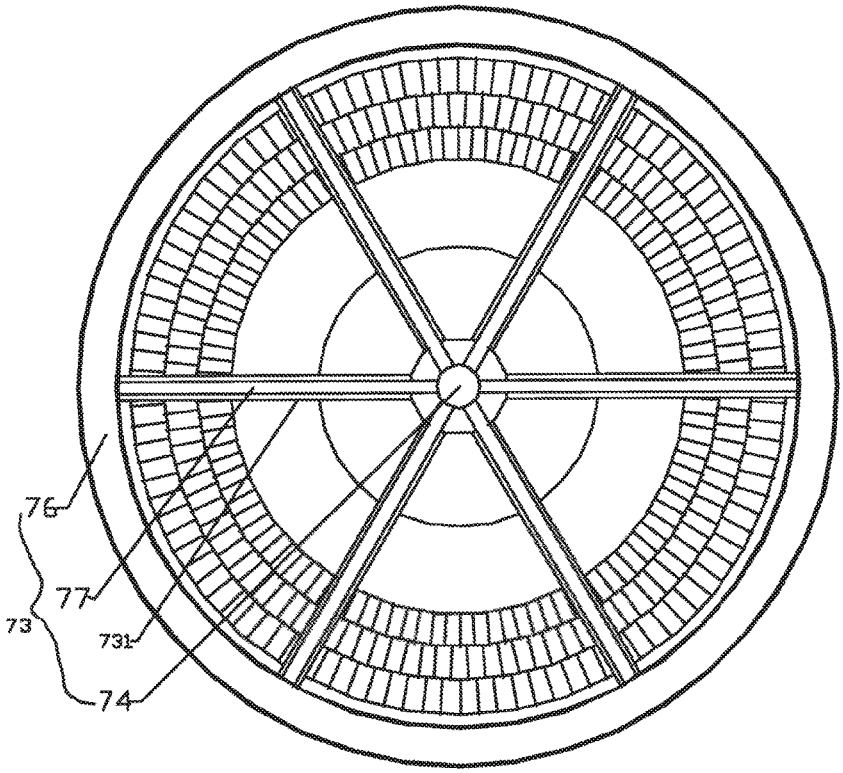
FIG. 23 is a sketch view of a coke quenching bridge arch of the present invention.

As shown in FIGS. 22 and 23, the dry quenching device 7 is located below the flame path arches 65 and comprises a high temperature coke quenching room 71, a low temperature coke quenching room 72, a coke quenching bridge arch 73 and a coke quenching exhaust blower 75; the high temperature coke quenching room 71 is provided below the flame path arch 65, a top portion of the high temperature coke quenching room 71 is communicated with the high temperature combustible waste gas path 653; the coke quenching bridge arch 73 is located between the and high temperature coke quenching room 71 and the low temperature coke quenching room 72 and comprises a bridge arch 731, a wind collecting room 74, a dry quenching wind annular path 76 and a dry quenching wind tube 77; six bridge arches are radially arranged within the quenching wind annular path 76 at a certain degree from an axial center of the high temperature coke quenching room 71 and the low temperature coke quenching room 72, a middle of the bridge arch 731 forms the wind collecting room 74 having an inversed conical shape with an upper large diameter and a lower small diameter, a semi-spherical air cap 78 is located at a top of the wind collecting room 74, an opening 79 at the lower portion of the wind collecting room 74 faces to the low temperature coke quenching room 72; the dry quenching wind tube 77 is located within the bridge arch 731, one end of the dry quenching wind tube 77 leads to the wind collecting room 74, the other end of the dry quenching wind tube 77 leads to the dry quenching wind annular path 76, the dry quenching wind annular path 76 is connected with the coke quenching exhaust blower 75 via a wind inputting tube 761; a coking valve 70 is located at a bottom opening 721 of the low temperature coke quenching room 712.

As shown in FIG. 22, the coke quenching temperature observing hole 711 leading to the high temperature coke quenching room 71 is provided at the external wall of the furnace body 91, and the coke quenching thermometer 712 is located within the coke quenching temperature observing hole.

As shown in FIG. 24, the coke quenching thermometer 712, the coke quenching exhaust blower 75 and the coking valve 70 are electrically connected with the control center 90. The control center 90 automatically controls the coke quenching exhaust blower 75 and the coking valve 70, and monitors the coke quenching temperature via the coke quenching thermometer 712. The coke quenching thermometer 712, the coke quenching exhaust blower 75 and the coking valve 70 are electrically connected with the control center 90 via the coke quenching device controller 907. Of course, seen from the electrical control principle, the coke quenching device controller 907 is not the limit to the protection scope of the present example.

The method of dry quenching using the low temperature combustion waste gas in the dry quenching device 7 is described as follows.

(1) The waste gas produced by coal gas combustion in the first gas heater 62 of the external gas heating device 64, the gas heater 60, the third gas heater 68 of the internal gas heating device 67, and the fourth gas heater 69 is introduced into the coke quenching exhaust blower 75. The waste gas produced by coal gas combustion naturally turns to the low temperature waste gas with relatively lower temperature after being absorbed the heat via the heat storing body;

(2) The low temperature waste gas passes through the wind inputting tube 761, the dry quenching wind annular path 76 and the dry quenching wind tube 77 in sequence to the wind collecting room 74 via the coke quenching exhaust blower 75, the low temperature waste gas gathers in the wind collecting room 74. The wind collecting room 74 adopts the special structure, the air cap 78 on the top thereof is semi-spherical, the middle chamber of the wind collecting room 74 has the inversed conical structure, so the low temperature waste gas is blown out from the bottom opening 79 to the low temperature coke quenching room 72, and then to the high temperature coke quenching room 71 for reducing the temperature of the coke in the high temperature coke quenching room 71 and the coke falling from the high temperature coke quenching room 71 to the low temperature coke quenching room 72. In this example, the temperature of the coke is decreased by air cooling, which is called as dry quenching;

(3) Furthermore, during the dry quenching, the dry quenching device 7 is capable of producing a certain amount of high temperature combustible gas, and the reason is that: firstly, the low temperature waste gas containing a small amount of water makes the chemical reaction while encountering the modified high temperature coke to produce some combustible gases; secondly, partial insufficiently combustion combustible gases exist in the low temperature waste gas itself; thirdly, partial combustible gases exist in the modified high temperature coke itself, these combustible gases move upwardly to the high temperature combustible exhaust path 653 in the middle of the flame arch central annular wall 652, so as to provide the gas source for the internal main flame path 636 and the internal sub flame path 637 of the internal burning heating device 67 of the coal pyrolyzing furnace.

In this example, the low temperature waste gas is produced as follows. The raw gas produced by the coal pyrolyzing is recycled and purified to the clean gas, and then the clean gas passes through the external gas heating device of the coal pyrolyzing furnace and the gas heater of the internal gas heating device for combustion, so that the waste gas is produced, the waste gas turns to the low temperature waste gas by the heat absorption and temperature decrease via the heat storing body of the heat storing chamber. The advantages of the dry quenching device of the present invention are that: the uncombustible combustion waste gas is used to make the dry quenching instead of the existing $N_2$, the equipment is simple, the cost is low, and the economic effect is significant. Compared with the conventional wet coke quenching, the present invention avoids discharging large amount of water coal gas result from a large amount of water encountering the high temperature coke to atmosphere, has less air pollution and water saving, and is capable of sufficiently utilizing the raw gas during the coal pyrolyzing process.

Section V: Continuous Quenching Device

All in all, a big advantage of the coal pyrolyzing furnace of the present invention is continuous quenching instead of conventional intermittent quenching or soil quenching. Compared with the conventional quenching methods, the present invention has incomparable advantages.

As shown in FIG. 25, a continuous quenching device comprises: a coal pyrolyzation coking device 6, a coke modification device 610 and a dry quenching device 7. The coal pyrolyzation coking device 6, the coke modification device 610 and the dry quenching device 7 form an integrated body on the furnace body 91 from top to bottom. Structures of the coal pyrolyzation coking device 6, the coke modification device 610 and the dry quenching device 7 are identical to illustrated mentioned above.

Quenching method of the continuous quenching device in the preferred embodiment comprises steps of:

(1) sending inputting coal to a coking chamber of a coal pyrolyzation coking device 6 to be heated for pyrolyzing;

(2) directly dropping the inputting coal after pyrolyzing into a coke modification device 610 for coke modification, where specific method is illustrated in section 2 part 4;

(3) dry quenching cooling coke after modification directly dropping into a dry quenching device 7 by low-temperature exhaust gas after burning, so as to generate high temperature combustible gas, wherein specific dry quenching method is illustrated in section 4 part 4;

(4) discharging from a bottom opening 721 of a low temperature quenching chamber 72 of the dry quenching device 7.

The heating method of the step (1) is to lead out the raw gas generated in the process of coal pyrolyzation by the coal pyrolyzation coking device 6. The raw gas is recycled and cleaned to obtain purified gas which is conveyed back to burn for providing heat and temperature for coal pyrolyzation. The method include a purified gas burning and heating method in the external combustion gas heating method and the internal combustion gas heating method. The external combustion gas heating method and the internal combustion gas heating method is illustrated in detain in section 1 part 4.

The low temperature exhaust in the step (3) is burning exhaust generated by combustion of the purified gas in the step (1) being flameout for hypothermy, and then is performed with dry quenching by the coke in the dry quenching device 7. High temperature combustible is guided to the coke modification device 610 for performing the coke modification in the step (2). The high temperature combustible after coke the modification is guided to the coke modification 610 for performing the coke modification in the step (2). The high temperature combustible after the coke modification of the step (2) is guided to a quenching exhaust heater 63 of the coal pyrolyzation coking device 6 to be performed with air admission combustion for providing heat and temperature to coal pyrolyzation of the step (1).

Characteristics of the continuous coking are as follows. The technologies of coking, modification and dry quenching are integrated in one pyrolyzing furnace body, in such a manner that coking, modification and dry quenching are achieved continuously, which overcomes problems in the conventional intermittent coking technology of low efficiency, large plant areas for large amount of devices and high labor cost.

Part V Combined Cycle of Coal Pyrolyzing Gas

Chapter 1 recovery, purification and utilization of raw gas (exporting, condensation and chemical production)

Section I Raw Gas Exporting Device

Raw gas produced during coal pyrolyzing comprises many useful ingredients, such as $H_2S$, HCL acid gases, $NH_3$ alkaline gas, tar, benzene, naphthalene, and absorber oil, and requires exporting the raw gas for utilizing.

Figure 26:
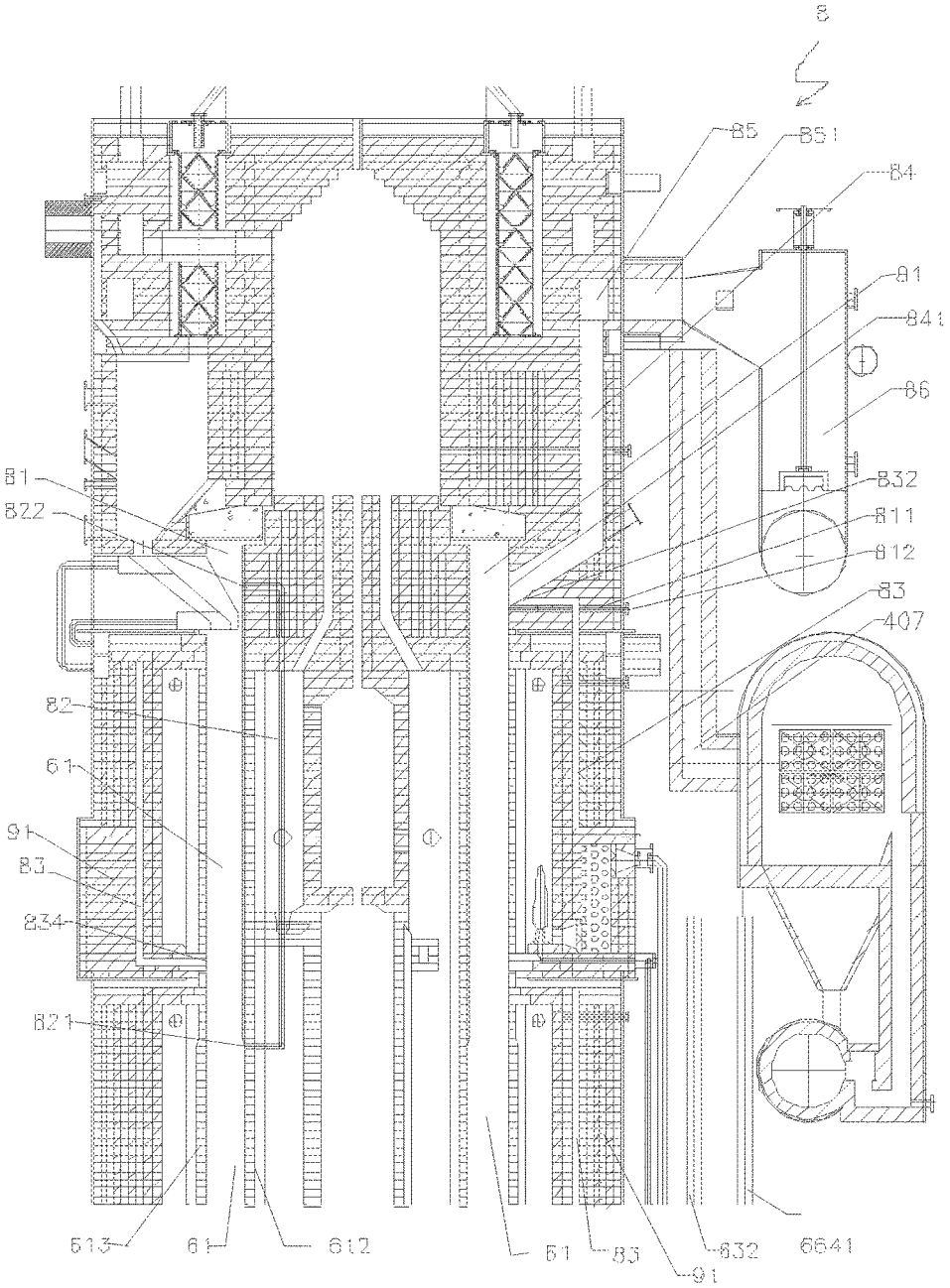
FIG. 26 is a raw gas exporting device of the present invention. (which is also an enlarged view of G in FIG. 25).

As shown in FIG. 26, a raw gas exporting device 8, comprises a raw gas collection chamber 81, an internal exporting pipe 82, an external exporting pipe 83, a main exporting pipe 84 and a loop exporting pipe 85;

wherein the raw gas collection chamber 81 is provided on a top of the coking chamber 61 and forms an integrated body with the coking chamber 61;

referring to FIGS. 17 and 26, the internal exporting pipe 82 is located inside the flame path isolating wall 635;

an internal exporting pipe inlet 821 passes through a center of an internal loop wall 612 and extends to the coking chamber 61;

an internal exporting pipe outlet 822 passes through the internal loop wall 612 and extends to the raw gas collection chamber 81 on a top of the raw gas collection chamber 81;

referring to FIGS. 17, 26 and 11, the external exporting pipe 83 is located in an external wall of the furnace body 91, a lower exporting pipe inlet and an upper exporting pipe inlet 834 pass through a center of an external loop wall 613 and extend to the coking chamber 61, the external exporting pipe outlet 832 passes through the external loop wall 613 and extends to the raw gas collection chamber 81 on the top of the coking chamber.

As shown in FIG. 26, the main exporting pipe 84 is provided on the external wall of the furnace body 91 of the coal pyrolyzing furnace. A main exporting pipe inlet 841 is communicated with the raw gas collection chamber 81 and extends to the loop exporting pipe 85 on an upper portion of the external wall of the furnace body 91. The raw gas exporting outlet 851 is provided on the loop exporting pipe 85.

Referring to FIGS. 26, 17, 11 and 12, in the preferred embodiment, the coking chamber 61 is in an annular chamber, so the raw gas collection chamber 81 is in an annular chamber accordingly. 6 internal exporting pipe 82 are respectively provided in the flame path isolating wall 635, pass through the internal loop wall 612 and extend to the coking chamber 61. 6 external exporting pipes 83 are respectively provided on a center of the external wall of the furnace body 91, pass through the internal loop wall 612 and lead to the coking chamber 61. Since a periphery of the coking chamber 61 is long, a plurality of internal exporting pipe inlets 821, lower exporting pipe inlets and upper exporting pipe inlets 834 are respectively provided on the internal loop wall 612 and external loop wall 613 of the coking chamber 61. Furthermore, because the coking chamber 61 has a high height, the internal exporting pipe inlets 821, the lower exporting pipe inlets and the upper exporting pipe inlets 834 are staggered provided. As shown in FIG. 26 and FIG. 11, the internal exporting pipe inlets 821 is higher than the lower exporting pipe inlets and lower than the upper exporting pipe inlets 834. The structure in the preferred embodiment is capable of fully exporting the raw gas generated in different sections of the coking chamber 91. In addition, 4 main exporting pipes 84 having greater sectional areas are provided on a periphery of the raw gas collection chamber 81 and leads to the loop exporting pipe 85, so as to facilitate exporting a huge amount of raw gas in the raw gas collection chamber 81.

As shown in FIG. 26, a raw gas temperature monitoring hole 811 leading to the raw gas collection chamber 81 is provided on the external wall of the furnace body 91. The raw gas thermometer 812 is provided in the raw gas temperature monitoring hole 811.

As shown in FIG. 24, the raw gas thermometer 812 is electrically connected with the industrial control core 90. The industrial control core 90 monitors temperatures of the raw gas collection chamber 81 via the raw gas thermometer 812.

In this preferred embodiment, raw gases generated in different sections of the coking chamber 61 respectively access the internal exporting pipe 82 and the external exporting pipe 83 from the internal exporting pipe inlets 821, the lower exporting pipe inlets and the upper exporting pipe inlets 834. A large amount of raw gas in the the coking chamber 61 directly rises and enters the raw gas collection chamber 81. The large amount of raw gas in the raw gas collection chamber 81 accesses the loop exporting pipe 85 via the main exporting pipe 84, and finally is discharged from the raw gas exporting outlet 851.

Section II Raw Gas Condensation Device

The raw gas exported from the raw gas exporting inlet has a high temperature. In order to facilitate transportation of high temperature raw gas before chemical production, the raw gas condensation device is needed for cooling the high temperature raw gas.

Section III Recycle and Purification of the Raw Gas

After spraying ammonia, the gas together with the mixture of coal tar and ammonia hydroxide are transmitted to a gas-liquid separation device for gas-liquid separation. After gas-liquid separation, the mixture of gas and liquid contains many kinds of useful organic ingredients such as phenol oil, naphthalene oil, wash oil, anthracene oil for industrial extracting other ancillary products. After the gas-liquid separation, the raw gas is performed with air cooling, and then is recycled and purified by a dry process recovery device to obtain purified coal gas which can be stored for combustion.

Chapter II Cycling of Raw Gas after Recovery and Purification (Combustion, Dry Quenching, Coke Modification, Secondary Combustion, Preheating of Inputting Coal, Dehydration of Inputting Coal and Air Admission Combustion)

Section I Combustion of Purified Gas after Recycling Raw Gas

After purifying and recycling, part of the purified gas is transmitted to the combustion gas heaters of the external combustion gas heating device and the internal combustion gas heating device for combustion, so as to provide heat source for the coal pyrolysis.

Section II Dry Quenching of Exhaust after Burning the Purified Gas

Out clean gas combustion in gas heating device in the gas heater and heating device in the gas heater is not completely full burning, not completely full combustion exhaust gas is used to analyse the high temperature of coke dry quenching and cooling, not completely full combustion exhaust gas water contact with high temperature coke reaction happens in the water gas, at the same time take away heat coke residual volatile combustible gas after modification, the final formation of high temperature exhaust gas containing combustible gas ingredients, see above dry quenching section introduces, go here.

Section III Coke Modification of High Temperature Combustible Exhaust after Dry Quenching Dry out after the high temperature of combustible waste gas temperature is 1000° C.~1100° C., the coke quality of just the need for thermal insulation in the temperature modification, specific how to conduct thermal modification, see above dry quenching section introduces, go here.

Section IV Air Admission Combustion of High Temperature Combustible Exhaust after Dry Quenching High temperature and combustible waste gas in the process of modification of coke isothermal, temperature will be lower, will fall to 900° C.~1000° C., and chamber needed for coal pyrolysis carbonization temperature is higher, on average in 1400° C.~1500° C., so add to the high temperature and combustible gas into air for combustion heating for the first time, because the chamber height is higher, and the high temperature and combustible gas exist a certain amount of combustible ingredients in, so you need to burn in central heating device to increase the third gas heater, the fourth gas heater to supply heat required for coal pyrolysis, the upper combustion heating device, and then to add a second time into sufficient combustible gas and combustion air to a very high heat, both to provide coal pyrolysis heat source power, and can make high temperature and combustible gas fully burning, reduce pollution to the atmospheric environment, see above boiling coal pyrolysis carbonization of narrative, go here.

Section V Preheating Inputting Coal by Hot Exhaust after Air Admission Combustion The exhaust of the quenching exhaust heater of the internal combustion heating device is discharged to the exhaust chamber, so as to preheat the inputting coal via the coal preheating device.

Section VI Heating the Air Admission Combustion

After coal heater preheating of exhaust gas to the tubular heat exchanger to enter the coke quenching heating air in the exhaust gas heater, requires no additional heat source for air heating, without additional cost, both plays for after coal heater preheating hot flue gas waste heat to increase the use of, and to add the hot air in the coke quenching waste gas heater, high temperature and combustible waste gas in the coke quenching waste gas heater full combustion.

Section VII Dehydration of Inputting Coal

After heating the air admission combustion, temperature of the hot exhaust drops, which is at 800° C. or below. A first part of the hot exhaust which has a relatively high temperature can be utilized for dehydration of the inputting coal.

Section VIII Reheating a Saturated Active Coke

After heating the air admission combustion, temperature of the hot exhaust drops, which is at 800° C. or below. A second part of the hot exhaust which has a relatively high temperature can be utilized for reheating a saturated active coke.

Part VI: Coal Pyrolyzing Automotive Control Device

In summary, the coal pyrolyzing automotive control device comprises the industrial control core, and thermometers and motors which are connected with the industrial control core.

Part VII: Thermal Cycle Continuous Automated Coal Pyrolyzing Furnace

A thermal cycle continuous automated coal pyrolyzing furnace and a pyrolyzing method thereof obtained by illustrations mentioned above of feeding inputting coal, preheating, adding coal, coking, coke modifying, dry quenching and raw gas exporting.

As shown in FIG. 25, a thermal cycle continuous automated coal pyrolyzing furnace 9, comprises: a furnace body 91, a coal feeding device 2, a plurality of preheating devices 39, an inputting coal regulating bunker 3, an inputting coal cooling device 5, a coal pyrolyzation coking device 6, a coke modification device 610, a dry quenching device 7 and a raw gas exporting device 8;

wherein the coal pyrolyzation coking device 6 comprises a coking chamber 601, an external combustion gas heating device 64, an internal combustion gas heating device 67 and a flame path arch 65.

Specific structures of the coal feeding device 2, the preheating devices 39, the inputting coal regulating bunker 3, the inputting coal cooling device 5 are illustrated in the Part III.

The coal pyrolyzation coking device 6, the coking chamber 61, the external combustion gas heating device 64, the internal combustion gas heating device 67 and the flame path arch 65 are detailed described in the Part IV. The specific structures of the raw gas exporting device 8 are illustrated in section I, chapter I, Part: V.

A thermal cycle continuous automated coal pyrolyzing method, comprises steps of:

1. turning on a inputting coal dust conveyor 21 to send a certain amount of inputting coal after dehydration;

2. turning on a discharge control valve 24, wherein inputting coal in an inputting bunker 22 passes through a coal dust distribution chamber 26 and a inputting bunker discharge duct 29 and enters a preheater 393 for preheating; after preheating, the inputting coal drops into a small bunker 31; when a bunker feeding level indicator 32 detects the inputting coal in the small bunker is full, the discharge control valve 24 is turned off to terminate adding coal to the small bunker 31, and the inputting coal is prestored in the small bunker 31;

3. when a coking chamber 61 needs adding coal, turning on a small bunker discharging valve 36 to send inputting coal into the coking chamber 61;

4. when addition of coal to the coking chamber 61 needs terminating, turning off the small bunker discharging valve 36 to terminate adding coal to the coking chamber 61;

5. when a bunker discharging level indicator 33 detects an amount of inputting coal of the small bunker 31 is insufficient, turning on the discharge control valve 24 to add coal to the small bunker 31; and when a bunker feeding level indicator 32 detects the amount of coal in the small bunker 31 is enough, turning off the discharge control valve 24 to terminate adding coal to the small bunker 31;

6. heating the inputting coal in the coking chamber 61 of a coal pyrolyzation coking device 6 for pyrolyzing;

7. dropping the inputting coal after pyrolyzing directly into the coke modification device 610 for coke modifying;

8. dry quenching cooling coke directly dropping into a dry quenching device 7 after coke modification utilizing low temperature exhaust after burning, so as to generate high temperature combustible gas; and 9. finally discharging the gas from a bottom opening 721 of a low temperature quenching chamber 72 of a dry quenching device 7;

wherein heating method in the step (6) leads out raw gas generated by coal pyrolyzing in the coal pyrolyzation coking device 6, purified gas by recycling and purifying raw gas is transmitted back for burning, so as to provide heat and temperature required by coal pyrolyzation; and the heating method comprises a purified gas heating and combusting method of an external combustion gas heating method and an internal combustion heating method, which are specifically introduced in Chapter I, Part: IV.

What is claimed is:

1. A thermal cycle continuous automated coal pyrolyzing furnace, comprising: a furnace body, a coal feeding device, a plurality of preheating devices, an inputting coal regulating bunker, an inputting coal cooling device, a coal pyrolyzation coking device, a coke modification device, a dry quenching device and a raw gas exporting device;

wherein the coal feeding device, the preheating devices, the inputting coal regulating bunker, the inputting coal cooling device, the coal pyrolyzation coking device, the coke modification device, the dry quenching device and the raw gas exporting device are all integrated on the furnace body;

the coal pyrolyzation coking device comprises a coking chamber, an external combustion gas heating device, an internal combustion gas heating device and a flame path arch;

the coal feeding device comprises: an inputting coal dust conveyor, an inputting bunker, a coal dust direction divider, a coal dust distribution chamber, an inputting bunker discharge duct and a coal dust filter;

the coal dust filter is located above the inputting coal dust conveyor, the inputting coal dust conveyor adopts a screw conveying structure and is provided on a top of the inputting bunker, a convex coal dust direction divider is provided on a middle of a bottom of the inputting coal bunker and divides the bottom of the inputting bunker into a plurality of coal dust distribution chambers;

the inputting bunker discharge duct is provided on the coal dust distribution chambers, and a discharge control valve is provided on the inputting bunker discharge duct;

the preheating devices are provided below the coal feeding device and on a top of the coal pyrolyzing furnace;

the preheating devices comprise the furnace body, an exhaust gas chamber, at least one exhaust gas preheating pipe and a preheater;

wherein the furnace body comprises an internal layer wall, a middle layer wall and an external layer wall;

the internal layer wall forms the exhaust gas chamber, and an exhaust gas gathering loop channel is formed between the middle layer wall and the external layer wall;

the exhaust gas gathering loop channel has an exhaust gas main outlet, the exhaust gas preheating pipe passes through the internal layer wall and the middle layer wall for communicating the exhaust gas chamber with the exhaust gas gathering loop channel, and divides a position between the internal layer wall and the middle layer wall into a plurality of preheating chambers, the preheaters are respectively provided in each of the preheating chambers;

a hot exhaust gas inputting pipe is provided on a bottom of the exhaust gas chamber, hot exhaust gas after burning, which is gas collected from an internal heating device after combustion and is collected and discharged from the exhaust gas chamber, enters the hot exhaust gas inputting pipe, accesses the exhaust gas gathering loop channel via the exhaust gas preheating pipe, and finally is discharged via the exhaust gas main outlet of the exhaust gas gathering loop channel, hot exhaust gas after burning performs heat conduction on the exhaust gas preheating pipe, the internal layer wall and the middle layer wall during the process of discharging;

the inputting coal regulating bunker is provided on the coking chamber below the preheating devices of the coal pyrolyzing furnace, the inputting coal regulating bunker comprises: a small bunker, a bunker feeding level indicator, a bunker discharging level indicator, a small bunker discharging pipe and a small bunker discharging valve;

a top portion of the small bunker is connected with a bottom portion of the preheating device, the bunker feeding level indicator and the bunker discharging level indicator are respectively provided on a top and a bottom of the small bunker, the small bunker discharging pipe is connected on a bottom of the small bunker via the small bunker discharging valve and extends to the coking chamber of the coal pyrolyzing furnace;

wherein the inputting coal cooling device comprises: an air inlet pipe, an air outlet pipe, an air inlet loop pipe, an air outlet loop pipe, an air inlet branch pipe, an air outlet branch pipe and a cooling air duct;

wherein the air inlet pipe is communicated with the air inlet loop pipe and the air outlet pipe is communicated with the air outlet loop pipe;

the air inlet loop pipe and the air outlet loop pipe are respectively provided on a periphery of the furnace body of the coal pyrolyzing furnace;

the air inlet branch pipe and the air outlet branch pipe are respectively provided on the air inlet loop pipe and the air outlet loop pipe;

wherein the air inlet branch pipe is provided on a lower portion of the cooling air duct, and the air outlet branch pipe is provided on an upper portion of the cooling air duct;

the small bunker discharging pipe passes through the cooling air duct and extends to the coking chamber;

the coal pyrolyzing coking device, the coke modification device and the dry quenching device are formed integrally from top to bottom on the furnace body, and the coal pyrolyzing coking device is arranged in a center of the furnace body, which comprises: the coking chamber, the external gas heating device, the internal burning heating device and the flame path arch;

the coking chamber is in a loop chamber above the flame path arch, the loop chamber is formed by an internal loop wall and an external loop wall made of fire-resistant and heat-conductive materials; the external gas heating device is around an external circle of the external loop wall of the coking chamber, wherein the external gas heating device comprises at least one equal set of a first gas heater, a second gas heater and a gas reversing device;

the internal burning heating device is provided inside the internal loop wall of the coking chamber, the internal burning heating device comprises at least one set of third gas heaters and fourth gas heaters which have same structures and coke quenching exhaust heaters;

wherein the coke modification device is located on the flame path arch within the furnace body, and comprises a coke modification room formed by the lower portion of the coking chamber, a lower portion of an internal main flame path and a lower internal sub flame path section of the internal burning heating device, a lower portion of a high temperature combustible waste gas inputting path of a central path encircled by a central annular wall of the internal burning heating device, wherein a combustible exhaust inputting hole is provided on a lower portion of the central annular wall for communicating the high temperature combustible waste gas inputting path with the internal main flame path and the lower internal sub flame path section;

the dry quenching device is located below the coking chamber, the coke modification device, the internal burning heating device and the flame path arch in the coal pyrolyzing furnace and comprises a high temperature coke quenching room, a low temperature coke quenching room, a coke quenching bridge arch and a coke quenching exhaust blower;

the high temperature coke quenching room is provided below the flame path arch, a top portion of the high temperature coke quenching room is communicated with the high temperature combustible waste gas path;

the coke quenching bridge arch is located between the high temperature coke quenching room and the low temperature coke quenching room and comprises a bridge arch, a wind collecting room, a dry quenching wind annular path and a dry quenching wind tube;

at least one bridge arch is radially arranged within the quenching wind annular path at a certain degree from an axial center of the high temperature coke quenching room and the low temperature coke quenching room, a middle of the bridge arch forms the wind collecting room having an inversed conical shape with an upper large diameter and a lower small diameter, a semi-spherical air cap is located at a top of the wind collecting room, an opening at the lower portion of the wind collecting room faces to the low temperature coke quenching room;

the dry quenching wind tube is located within the bridge arch, one end of the dry quenching wind tube leads to the wind collecting room, the other end of the dry quenching wind tube leads to the dry quenching wind annular path, the dry quenching wind annular path is connected with the coke quenching exhaust blower via a wind inputting tube; a coking valve is located at a bottom opening of the low temperature coke quenching room;

wherein the raw gas exporting device comprises a raw gas collection chamber, an internal exporting pipe, an external exporting pipe, a main exporting pipe and a loop exporting pipe;

wherein the raw gas collection chamber is provided on a top of the coking chamber and forms an integrated body with the coking chamber;

the internal exporting pipe is located inside a flame path isolating wall;

an internal exporting pipe inlet passes through the internal loop wall of the coking chamber and extends to the coking chamber;

an internal exporting pipe outlet passes through the internal loop wall and extends to the raw gas collection chamber on a top of the coking chamber;

the external exporting pipe is located in an external wall of the furnace body, and comprises a lower exporting pipe inlet and an upper exporting pipe inlet which pass through the external loop wall of the coking chamber and extend to the coking chamber;

an external exporting pipe outlet passes through the external loop wall and extends to the raw gas collection chamber on the top of the coking chamber;

the main exporting pipe is provided in the external wall of the furnace body of the coal pyrolyzing furnace, a main exporting pipe inlet is communicated with the raw gas collection chamber and extends upwardly to an exporting loop pipe on an upper portion of the external wall of the furnace body, and a raw gas exporting outlet is provided in the exporting loop pipe;

wherein the coke quenching exhaust heater of the internal burning heating device comprises an internal flame path, an air assisting tube, a primary gas refilling tube, a secondary gas refilling tube, a gas refilling loop, a center loop wall, an internal flame path isolating wall and a center pass, wherein the internal flame path is divided into at least one set of an internal main flame path and an internal sub flame path in parallel by the internal loop wall of the coking chamber, the center loop wall inside the internal loop wall of the coking chamber and at least one the internal flame path isolating wall; an upper sealing isolation plate and a lower sealing isolation plate are provided in the internal sub flame path and divide the internal sub flame path into an upper section, a middle section and a lower section, which forms an upper internal sub flame path section, a middle internal sub flame path section and a lower inter sub flame path section; an exhaust communicating hole is drilled on a flame path isolating wall between the upper internal sub flame path section and the internal main flame path; the center pass is formed by the center loop wall, a pass isolating plate is provided at a part of the center pass which is abreast of the upper sealing isolating plate for dividing the center pass into an upper portion and a lower portion, in such a manner that the upper portion forms a buffer area and the lower portion forms a high-temperature combustible exhaust inputting pass; an exhaust inputting hole is drilled on the center loop wall and passes through the buffer area, the internal main flame path and the upper internal sub flame path section; a combustible exhaust inputting hole is drilled at a bottom portion of the center loop wall and passes through the high-temperature combustible exhaust inputting pass, the internal main flame path and the lower internal sub flame path section; the gas refilling loop is provided on an external wall of the coal pyrolyzing furnace and communicates with the air assisting tube as well as the primary gas refilling tube and the secondary gas refilling tube; the primary gas refilling tube and the secondary gas refilling tube pass below a strip arch of the flame path arch and extend upwards for being inside the flame path isolating wall between the internal main flame path and the internal sub flame path; an opening of the primary gas refilling tube is arranged under the lower isolating plate and respectively connected to the internal main flame path and the internal sub flame path; an opening of the secondary gas refilling tube is connected to the internal main flame path; the middle internal sub flame path section forms a closed independent gas combustor; adjacent middle internal sub flame path sections communicate with each other through a combustor pass and forms a cooperating set, the combustor pass is under the upper isolating plate and passes through the internal main flame path between the adjacent middle internal sub flame path sections; the third gas heater comprises a third combustor, a third coal gas inputting sub-tube, a third heat storing chamber, a third heat storing body, a third air inputting sub-tube and a third exhaust outputting sub-tube, wherein the third combustor is formed by the middle internal sub flame path section, the third coal gas inputting sub-tube passes below the strip arch of the flame path arch and extends upwards for being connected to the third combustor by passing through the flame path isolating wall which is formed by the middle internal sub flame path section; the third heat storing chamber is arranged on the body of the coal pycolyzing furnace under the strip arch, and the third heat storing body is arranged inside the third heat storing chamber; a first end of the third heat storing chamber passes below the strip arch of the flame path arch through an extending pass and extends upwards for being connected to a bottom of the third combustor by passing through the flame path isolating wall, a second end of the third heat storing chamber is respectively connected to the third air inputting sub-tube and the exhaust outputting sub-tube; similarly, the —fourth gas heater is identical to the third gas heater in structures, wherein a fourth combustor forms a parallel set with the third combustor through the combustor pass.

2. The thermal cycle continuous automated coal pyrolyzing furnace, as recited in claim 1, wherein the external gas heating device heats with an upper heating section, a middle heating section and a lower heating section, each heating section comprises a plurality of sets of the first gas heating devices and the second gas heaters with same structures.

3. The thermal cycle continuous automated coal pyrolyzing furnace, as recited in claim 1, wherein the coal dust filter comprises: a filter shell, an exhaust air internal inlet pipe, a dust funnel, an exhaust air internal outlet pipe and an exhaust air external outlet pipe;

the exhaust air internal inlet pipe is provided on a periphery of the filter shell and extends from a bottom to a top, the dust funnel is provided in the filter shell and extends to the bunker, the exhaust air internal outlet pipe is provided on a header of the filter and above the dust funnel;

an entrance of the exhaust air internal inlet pipe is higher than an entrance of the exhaust air internal outlet pipe, the exhaust air internal outlet pipe is provided on a header in the filter, and the exhaust air external outlet pipe is provided on a filter external header; and a metal fiber filter is provided between the filter internal header and the filter external cover.

4. The thermal cycle continuous automated coal pyrolyzing furnace, as recited in claim 1, wherein the first gas heater of the external gas heating device comprises a first combustor, a first coal gas inputting sub-tube and a first storing heat exchanger, the first combustor forms a relatively closed coal gas combustion flame path, the first coal gas inputting sub-tube is communicated with a bottom of the first combustor, the first storing heat exchanger comprises a first heat storing chamber, a first heat storing body, a first air inputting sub-tube and a first exhaust outputting sub-tube, the first heat storing chamber is provided within an external wall of the furnace body, the first heat storing body is located within the first heat storing chamber, one end of the first heat storing chamber is communicated with the bottom of the first combustor, the other end of the first heat storing chamber is connected with the first air inputting sub-tube and the first exhaust outputting sub-tube; wherein the second gas heater comprises a second combustor, a second coal gas inputting sub-tube and a second storing heat exchanger, the second coal gas inputting sub-tube is communicated with a bottom of the second combustor, the second storing heat exchanger comprises a second heat storing chamber, a second heat storing body, a second air inputting sub-tube and a second exhaust outputting sub-tube, the second heat storing chamber is also provided within the external wall of the furnace body, the second heat storing body is located within the second heat storing chamber, one end of the second heat storing chamber is communicated with the bottom of the second combustor, the other end of the second heat storing chamber is connected with the second air inputting sub-tube and the second exhaust outputting sub-tube; wherein a combustor through-hole is provided between the first combustor and the second combustor; wherein the gas reversing device comprises an upper disk, a lower disk, a rotation reversing motor, an air blower, a coal gas blower and an exhaust blower, the lower disk is connected with an air main tube and a first air sub-tube, a second air sub-tube, a coal gas main tube and a first coal gas sub-tube, a second coal gas sub-tube, an exhaust main tube and a second exhaust sub-tube, and a first exhaust sub-tube, wherein the second exhaust sub-tube is exchanged with the first exhaust sub-tube, the first air sub-tube is exchanged with the second air sub-tube, and the first coal gas sub-tube is exchanged with the second coal gas sub-tube; wherein the upper disk is rotatably attached on the lower disk, an air communicating tube, a coal gas communicating tube and an exhaust communicating tube are located on the upper disk, the rotation reversing motor is driving-connected with the upper disk for driving the upper disk to reciprocately rotate on the lower disk; wherein, the first air sub-tube is connected with the first air inputting sub-tube, simultaneously, the first coal gas sub-tube is connected with the first coal gas inputting sub-tube, simultaneously, the first exhaust sub-tube is connected with the first exhaust outputting sub-tube; similarly, the second air sub-tube is connected with the second air inputting sub-tube, simultaneously, the second coal gas sub-tube is connected with the second coal gas inputting sub-tube via a second coal gas wrap-tube, simultaneously, the second exhaust sub-tube is connected with the second exhaust outputting sub-tube.

5. The thermal cycle continuous automated coal pyrolyzing furnace, as recited in claim 4, further comprising an industrial control core, wherein the industrial control core is connected with the inputting coal dust conveyor and the discharge control valve, so as to control the inputting coal dust conveyor and the discharge control valve, and the industrial control core is connected with a preheating chamber thermometer and an exhaust gas chamber thermometer for monitoring temperatures;

the industrial control core is electrically connected with the bunker feeding level indicator, the bunker discharging level indicator, the small bunker thermometer and the small bunker discharging valve, so as to regulate an amount of inputting coal and monitor temperature;

the industrial control core is electrically connected with a raw gas thermometer, and the industrial control core monitors temperatures of the raw gas collection chamber;

the industrial control core is connected with a burning chamber thermometer and automatically collects temperature data of the burning chamber thermometer;

the industrial control core is connected with the rotation reversing motor, the air blower, the coal gas blower and the exhaust blower, so as to control rotation of the rotation reversing motor, the air blower, the coal gas blower and the exhaust blower;

the industrial control core is electrically connected with a coke modification thermometer, so as to automatically monitor coke modification signals of the coke modification thermometer;

the industrial control core is electrically connected with a quenching thermometer, a quenching exhaust gas blower and a coke outlet exhaust gas valve, so as to automatically control the quenching exhaust gas blower and the coke outlet exhaust gas valve, and monitor quenching temperatures via the quenching thermometer; and the industrial control core is electrically connected with a raw gas thermometer, so as to monitor temperatures of the raw gas collection chamber.

* * * * *